US009555923B2

(12) United States Patent
Andria et al.

(10) Patent No.: US 9,555,923 B2
(45) **Date of Patent: *Jan. 31, 2017**

(54) METHOD FOR PREPARING MATTRESSES FOR SHIPMENT AND STACK OF MATTRESSES PREPARED USING SUCH METHOD

(71) Applicant: PRIMO BEDDING INC., Montreal (CA)

(72) Inventors: Niaina Andria, Terrebonne (CA); George Itzkovitz, Hampstead (CA)

(73) Assignee: PRIMO BEDDING INC., Montreal, Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/016,556

(22) Filed: Feb. 5, 2016

(65) Prior Publication Data

US 2016/0152377 A1 Jun. 2, 2016

Related U.S. Application Data

(63) Continuation of application No. 14/230,927, filed on Mar. 31, 2014, now Pat. No. 9,278,777.

(51) Int. Cl.
*B65D 19/00* (2006.01)
*B65B 13/20* (2006.01)
(Continued)

(52) U.S. Cl.
CPC ..... *B65D 19/0004* (2013.01); *B65B 13/00* (2013.01); *B65B 13/02* (2013.01); *B65B 13/20* (2013.01);
(Continued)

(58) Field of Classification Search
CPC ..... A47C 31/11; B65B 13/00; B65B 13/02; B65B 13/20; B65B 63/02; B65B 63/022; B65B 63/024; B65B 63/026; B65B 63/028; B65B 63/04; B65D 5/0095; B65D 9/12; B65D 9/38; B65D 19/0004–19/0044; B65D 85/62; B65D 85/64; B65D 2585/647; B65D 2585/649
(Continued)

(56) References Cited

U.S. PATENT DOCUMENTS 2,309,795 A 2/1943 Siegel
2,503,240 A 4/1950 Cahners
(Continued)

OTHER PUBLICATIONS

Flat pallets for intercontinental materials handling—Principal dimensions and tolerances—ISO 6780:2003—Abstract Only, 2 pages.

(Continued)

*Primary Examiner* — Bryon Gehman
(74) *Attorney, Agent, or Firm* — Sheridan Ross P.C.

(57) ABSTRACT

An assembly of stacked mattresses and a method for preparing such an assembly are provided. The assembly of stacked mattresses comprises a first pallet, a second pallet, a plurality of mattresses positioned between the first pallet and the second pallet and straps coupling the first pallet to the second pallet, the plurality of mattresses being in a compressed state between the first pallet and the second pallet and the straps restraining expansion of the plurality of mattresses. The second pallet is comprised of a supporting member and a plurality of elongated reinforcing members extending across the supporting member, at least some of the reinforcing members including respective strap guiding members extending longitudinally along the elongated reinforcing member. At least some of the straps engage respective ones of the strap guiding members of the plurality of elongated reinforcing member of the second pallet so that displacement of the straps is constrained by the strap guiding
(Continued)

members. In accordance with another aspect, a pallet for using in shipping bedding products is provided.

41 Claims, 16 Drawing Sheets

(51) Int. Cl.

| | |
|---|---|
| ***B65D 85/62*** | (2006.01) |
| ***B65D 71/00*** | (2006.01) |
| ***B65D 71/04*** | (2006.01) |
| ***B65D 85/16*** | (2006.01) |
| ***B65B 13/00*** | (2006.01) |
| ***B65D 6/16*** | (2006.01) |
| ***B65D 6/36*** | (2006.01) |
| ***B65B 13/02*** | (2006.01) |
| ***B65D 19/44*** | (2006.01) |

(52) U.S. Cl.
CPC . *B65D 9/12* (2013.01); *B65D 9/38* (2013.01); *B65D 19/0016* (2013.01); *B65D 19/0085* (2013.01); *B65D 19/44* (2013.01); *B65D 71/0096* (2013.01); *B65D 71/04* (2013.01); *B65D 85/16* (2013.01); *B65D 85/62* (2013.01); *B65D 2519/00288* (2013.01); *B65D 2519/00323* (2013.01); *B65D 2519/00333* (2013.01)

(58) Field of Classification Search
USPC .. 206/326, 386, 497, 499, 595–600; 53/436, 53/438; 108/51.3, 53.1, 53.3, 53.5, 108/55.1
See application file for complete search history.

(56) References Cited

U.S. PATENT DOCUMENTS

| | | | |
|---|---|---|---|
| 2,503,562 | A | 4/1950 | Porter |
| 3,908,850 | A | 9/1975 | Jureit et al. |
| 5,097,951 | A | 3/1992 | Pigott et al. |
| 5,271,498 | A | 12/1993 | Gillespie |
| 7,458,193 | B2 | 12/2008 | Andria et al. |
| 7,895,813 | B2 | 3/2011 | Andria et al. |
| 2008/0196633 | A1 | 8/2008 | Ho |
| 2009/0293431 | A1 | 12/2009 | Andria et al. |
| 2015/0274356 | A1 | 10/2015 | Andria et al. |

OTHER PUBLICATIONS

Office Action issued on May 1, 2015 in connection with U.S. Appl. No. 14/230,927, 8 pages.

Examiner's Report issued on Oct. 23, 2015 in connection with Canadian Patent Application No. 2,847,955; 2 pages.

Notice of Allowance issued on Oct. 27, 2015 in connection with U.S. Appl. No. 14/230,927, 13 pages.

METHOD FOR PREPARING MATTRESSES FOR SHIPMENT AND STACK OF MATTRESSES PREPARED USING SUCH METHOD

CROSS REFERENCE TO RELATED APPLICATIONS

This application is a continuation of, and claims priority under 35 U.S.C. §120 to, U.S. patent application Ser. No. 14/230,927 filed Mar. 31, 2014, which is incorporated herein in its entirety by reference.

FIELD OF THE INVENTION

The invention generally relates to the packaging of mattresses for shipment, and more particularly, to the packaging of mattresses for shipment in containers using air, sea or ground transportation.

BACKGROUND

Large quantities of mattresses are imported from overseas into Canada and the United States, in particular from China and other Asian countries. The importation of large quantities of mattresses is driven by the reality that manufacturers in China and other Asian countries are able to produce mattresses at a lower cost than manufacturers in North America. When these mattresses are being transported, they are typically packaged and carried via ship in containers. There is a cost associated with the shipping, which is in part a function of the volume occupied by the mattresses.

In view of reducing shipping costs, various methods have been used for packaging mattresses for shipment to allow placing more mattresses in a given container. As will be appreciated, if a larger number of mattresses can be packaged within a given space, the shipping costs associated with any individual mattress will be lower. One example of a method of preparing mattresses for shipment is suggested in U.S. Pat. No. 7,458,093 and U.S. Pat. No. 7,895,813, the contents of which are incorporated herein by reference. Generally speaking, the suggested approach includes first individually compressing and wrapping mattresses, for example, by vacuum sealing each individual mattress. Following this, a set of individually compressed mattresses is stacked between upper and lower shipping supports. The stack of mattresses is then further compressed between the supports, which are then fastened to one another using coupling restraints in the form of straps. Following this, the stacked mattresses with the upper and lower shipping supports can be placed within a container for shipping.

Approaches of the type described above advantageously may allow a larger number of mattresses to fit within a given container and thus may enhance transportation cost efficiency.

A deficiency associated with assemblies of stacked mattresses prepared using methods of the type described above is that, on occasion the straps and/or the shipping supports get damaged during transport or handling due in part to the pressure exerted on these components by the compressed stack of mattresses. When damage occurs, the result in some cases is that the compressed mattresses expand within the containers used for the shipment. This expansion within the containers often makes removing the mattresses such containers without damaging the mattresses difficult. As a result, the cost savings achieved by packing a larger number of mattresses per container is reduced by the cost of the damaged mattresses, which often can no longer be sold to customers.

In light of the above, there is a need in the industry for providing an improved assembly of stacked mattresses and an improved method for preparing such an assembly that alleviates, at least in part, the deficiencies with existing assemblies and methods.

SUMMARY

In accordance with a first aspect, the invention relates to an assembly of stacked mattresses comprising a first pallet, a second pallet, a plurality of mattresses positioned between the first pallet and the second pallet and straps coupling the first pallet to the second pallet. The plurality of mattresses is in a compressed state between the first pallet and the second pallet and the straps restrain expansion of the plurality of mattresses. The second pallet is comprised of a supporting member and a plurality of elongated reinforcing members extending across the supporting member, at least some of the reinforcing members including respective strap guiding members extending longitudinally along the elongated reinforcing member. At least some of the straps engage respective ones of the strap guiding members of the plurality of elongated reinforcing member of the second pallet.

In accordance with a first specific example of implementation, at least some of the strap guiding members are comprised of hollow tubular portions extending longitudinally along the elongated reinforcing members of the second pallet and at least some of the straps pass through at least some of the hollow tubular portions.

In accordance with a second specific example of implementation, at least some of the strap guiding members are comprised of U-shaped portions extending longitudinally along the elongated reinforcing members of the second pallet and wherein the at least some of the straps are positioned within at least some of the U-shaped portions, the U-shaped portions restraining movement of the at least some straps relative to the supporting member of the second pallet.

In accordance with another alternative specific example of implementation, at least some of the strap guiding members extend longitudinally along the elongated reinforcing members of the second pallet and are comprised of a combination of hollow tubular portions and U-shaped portions positioned end-to-end.

In specific practical implementations, the strap guiding members may be made, for example, of a metallic material and/or a plastic material. The supporting member of the second pallet may be made at least in part of a wood-based material, such as for example a medium-density fiberboard (MDF) or a plywood material. The straps used to couple the first pallet to the second pallet may be made of any suitable material such as for example nylon, polypropylene and synthetic steel composite. Advantageously, it has been found that, in some cases, straps made of synthetic steel composite tend to be less affected by temperature variations, and in particular tend to be less affect by cold temperatures, than similarly sized nylon straps which may render such straps more durable and less likely to break that nylon straps.

In specific practical implementations, the supporting member of the second pallet has a surface area substantially similar to a surface area of an individual mattress in the plurality of mattresses. In non-limiting implementations, the supporting member of the second pallet may have a substantially rectangular shape.

In specific implementations, the plurality of mattresses may include any suitable number of mattresses. The number of mattresses in practical implementations may generally be selected based upon the number of mattresses that, when compressed between the two pallets, can reasonably fit within the specific container that is to be used for the shipment.

In a specific implementation, the first pallet has a configuration similar to that second pallet and is comprised of:

i) a supporting member; and ii) a plurality of elongated reinforcing members extending across the supporting member, at least some of the elongated reinforcing members including respective strap guiding members extending longitudinally along the elongated reinforcing members.

In the assembly, at least some straps engage respective ones of the strap guiding members of the plurality of elongated reinforcing members of the first pallet.

In accordance with another aspect, the invention relates to a pallet for use in shipping bedding products. The pallet comprises a supporting member and a plurality of elongated reinforcing members extending across the supporting member. At least some of the elongated reinforcing members include respective strap guiding members extending longitudinally along the elongated reinforcing members.

In accordance with a first specific implementation, at least some of the strap guiding members are comprised of hollow tubular portions extending longitudinally along the elongated reinforcing members, the hollow tubular portions being adapted for receiving therethrough straps.

In accordance with a second specific implementation, at least some of the strap guiding members are comprised of U-shaped portions extending longitudinally along the elongated reinforcing members. The U-shaped portions are configured to receive therein straps and for restraining movement of straps positioned therein.

In specific practical implementations, the strap guiding members may be made, for example, of a metallic material or a plastic material. The supporting member of the second pallet may be made at least in part of a wood-based material, such as for example a medium-density fiberboard (MDF) or a plywood material. The straps used to couple the first pallet to the second pallet may be made of any suitable material such as for example nylon, polypropylene and synthetic steel composite.

In accordance with another aspect, the invention relates to the use of a pallet of the type described above for shipping bedding products, such as for example mattresses, pillows and the like.

In accordance with another aspect, the invention relates to a method for preparing mattresses for shipment. The method comprises providing a first pallet and a second pallet. The second pallet is comprised of a supporting member and of a plurality of elongated reinforcing members extending across the supporting member, at least some of the elongated reinforcing members including respective strap guiding members extending longitudinally along the elongated reinforcing members. The method further comprises placing a plurality of mattresses on a surface of one of the first pallet and the second pallet and placing the other one of the first pallet and the second pallet on top of the plurality of mattresses. The method also comprises compressing the plurality of mattresses between the first pallet and the second pallet and coupling the first pallet to the second pallet using straps, the straps restraining expansion of the compressed plurality of mattresses. At least some of the straps engage respective ones of the strap guiding members of the plurality of elongated reinforcing members of the second pallet.

In accordance with a first specific example of implementation, at least some of the strap guiding members are comprised of hollow tubular portions extending longitudinally along the elongated reinforcing members. In the method, the step of coupling the first pallet to the second pallet includes passing at least some of the straps through at least some of the hollow tubular portions.

In accordance with a second specific example of implementation, at least some of the strap guiding members are comprised of U-shaped portions extending longitudinally along the elongated reinforcing members. In the method, the step of coupling the first pallet to the second pallet includes positioning at least some of the straps within at least some of the U-shaped portions. In some implementations, the U-shaped portions may restrain movement of the at least some straps relative to the supporting member of the second pallet.

In a specific practical implementation, the supporting member of the second pallet has a surface area substantially similar to a surface area of an individual mattress in the plurality of mattresses.

In specific implementations, the plurality of mattresses may include any suitable number of mattresses. The number of mattresses in practical implementations may generally be selected based upon the number of mattresses that, when compressed between the two pallets, can reasonably fit within the specific container that is to be used for the shipment. Practical implementations may include placing two or more mattresses upon the first pallet.

In a specific implementation, the method further comprising compressing individually the mattresses in the plurality of mattresses prior to placing the plurality of mattresses on the first pallet.

In a specific implementation, the first pallet has a configuration similar that of the second pallet and is comprised of:

i) a supporting member; and ii) a plurality of elongated reinforcing members extending across the supporting member, at least some of the elongated reinforcing members including respective strap guiding members extending longitudinally along the elongated reinforcing members.

In this specific implementation, coupling the first pallet to the second pallet may further include engaging at least some of the straps with respective ones of the strap guiding members of the plurality of elongated reinforcing members of the first pallet.

In accordance with another aspect, the invention relates to an assembly of stacked mattresses prepared for shipment in accordance with a method of the type defined above.

In accordance with another aspect, the inventions relates to an assembly of stacked mattresses. The assembly comprises a first pallet, a second pallet, a plurality of mattresses positioned between the first pallet and the second pallet and straps coupling the first pallet to the second pallet. The plurality of mattresses is in a compressed state between the first pallet and the second pallet and the straps restrain expansion of the plurality of mattresses. The second pallet is comprised of a supporting member and of a plurality of elongated grove members extending across the supporting member. At least some of the straps engage respective ones of the elongated grove members of the second pallet.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

Figure 1:
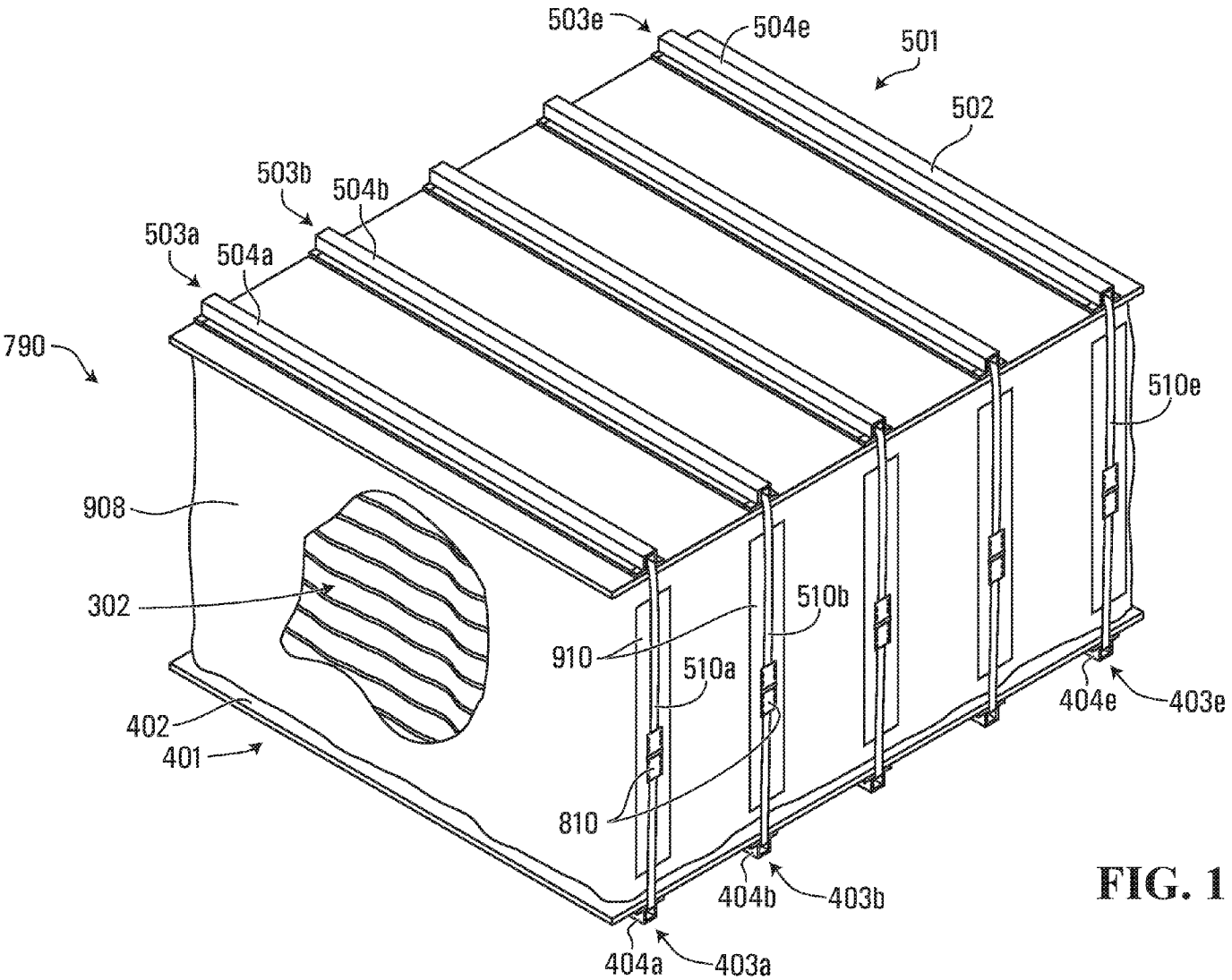
FIG. 1 shows an assembly of stacked mattresses in accordance with a specific example of implementation of the invention.

In the drawings, embodiments of the invention are illustrated by way of example. It is to be expressly understood that the description and drawings are only for the purpose of illustrating certain embodiments of the invention and are an aid for understanding. They are not intended to be a definition of the limits of the invention.

DETAILED DESCRIPTION

FIG. 1 shows a specific non-limiting example of an assembly of stacked mattresses. As shown, the assembly 790 includes a first pallet 401, a second pallet 501 and a plurality of mattresses 302 positioned between the first pallet 401 and the second pallet 501. In this example, the first pallet 401 is a lower pallet and the second pallet 501 is an upper pallet.

The plurality of mattresses 302 is arranged in a stack atop the first pallet 401 and the second pallet 501 is positioned on top of the plurality of mattresses 302. The assembly 790 also includes straps 510 coupling the first pallet 401 to the second pallet 501. In a specific implementation, the plurality of mattresses 302 is in a compressed state between the first pallet 401 and the second pallet 501 and the straps 510 restrain the expansion of the plurality of mattresses 302. In the example depicted, an optional protective cover 908 shields the plurality of stacked mattresses from outside elements. The optional protective cover 908 may be made of any suitable material which may include, without being limited to corrugated cardboard, packaging paper, plastic wrapping and/or a woven nylon protective material.

In the example depicted, the upper (or second) pallet 501 includes a supporting member 502 and a plurality of elongated reinforcing members 503 extending across the supporting member 502. The reinforcing members 503 include respective strap guiding members 504 extending longitudinally along the elongated reinforcing member 503. The straps 510 engage respective ones of the strap guiding members 504 as they couple together the first and second pallets 401 501. Advantageously, the elongated strap guiding members 504 may restrain movement of the straps 510 relative to the supporting member 502 and in that manner may reduce the amount of wear endured by the straps, which in turn may reduce the likelihood the straps will break. In this specific example, the elongated strap guiding members 504 include hollow tubular portions extending longitudinally along the elongated reinforcing members 503. The hollow tubular portions accommodate the straps 510, which pass through the hollow tubular portions.

In another example, not show in FIG. 1, the elongated strap guiding members may include U-shaped portions extending longitudinally along the elongated reinforcing members. The U-shaped portions are configured to accommodate the straps 510, which would be positioned within the U-shaped portions, the U-shaped portions restraining the lateral movement of at least some straps relative to the supporting member. It is to be appreciated that the elongated strap guiding members 504 may be otherwise configured to restrain movement of the straps 510 relative to the supporting member 502 and such alternatives will become apparent to the person skilled in the art in light of the present document.

In yet another example of implementation, not show in FIG. 1, instead of reinforcing members 503, the pallet may include a supporting member and a plurality of elongated grove members formed on a surface of the supporting member and extending across it. The grove members are shaped to accommodate the straps, which would be positioned within the grove members, and restrain the lateral movement of at least some straps relative to the supporting member.

In the specific example depicted, the lower (or first) pallet 401, is configured in a manner similar to the upper (or second) pallet 501 and includes a supporting member 402 and a plurality of elongated reinforcing members 403 extending across the supporting member 402. The reinforcing members 403 include respective strap guiding members 404 extending longitudinally along the elongated reinforcing member 403.

The straps 510 engage respective ones of the strap guiding members 404 and strap guiding members 504 as they couple the first and second pallets 401 501 with one another. The straps 510 may be made of any suitable material such as nylon, polypropylene, synthetic steel composite or any other suitable material. In some embodiments, the straps 510 may be steel bands. In the example depicted, the ends of the strap 510 are coupled together with respective coupling devices 810.

In the example depicted, optional protective strips 910 positioned on the sides of the stack of compressed mattresses 302 may be provided. These protective strips 910 are generally aligned with the straps 510 extending between the first and second pallets 501 401. More specifically, in some embodiments, the protective strips may be positioned to be generally aligned with the strap guiding members 404 and strap guiding members 504. Moreover, in some embodiments, the protective strips 910 may be placed on top of the protective cover 908, while in other embodiments the protective cover 908 may overlay the protective strips 910. The optional protective strips 910 may be made of any suitable material which may include, without being limited to polyurethane foam or felt padding. The use of protective strips 910 may advantageously reduce friction between the straps 510 and the stacked mattresses 302 and hence reduce the likelihood the straps will damage the mattresses during transport.

Figure 2A:
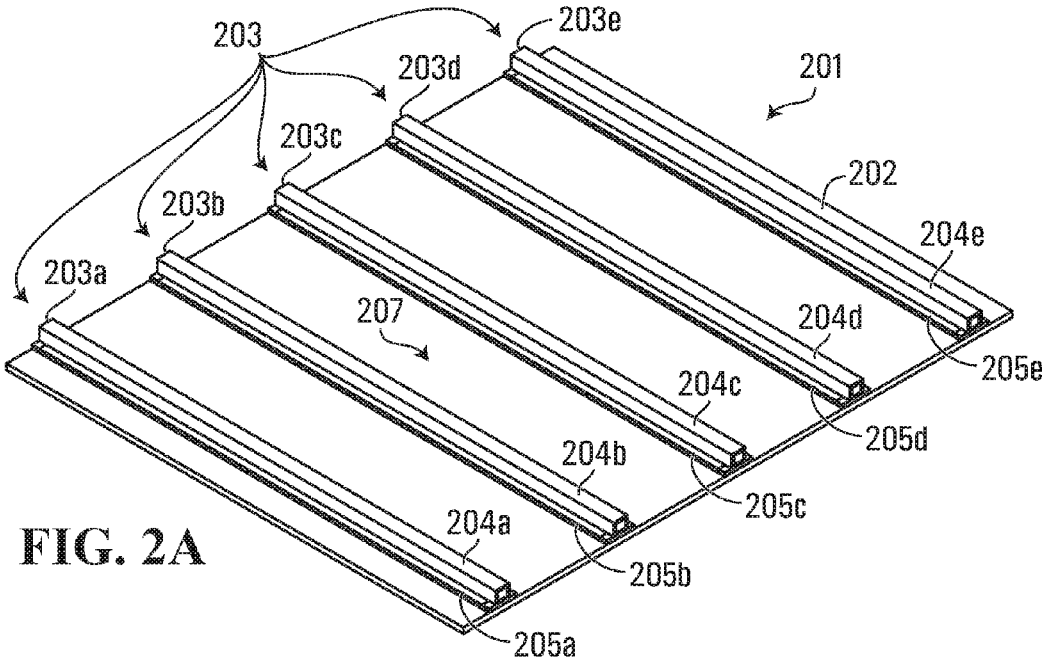
FIGS. 2A and 2B are perspective views of a pallet suitable for use in an assembly of the type shown in FIG. 1 in accordance with a first embodiment of the invention.
Figure 2B:
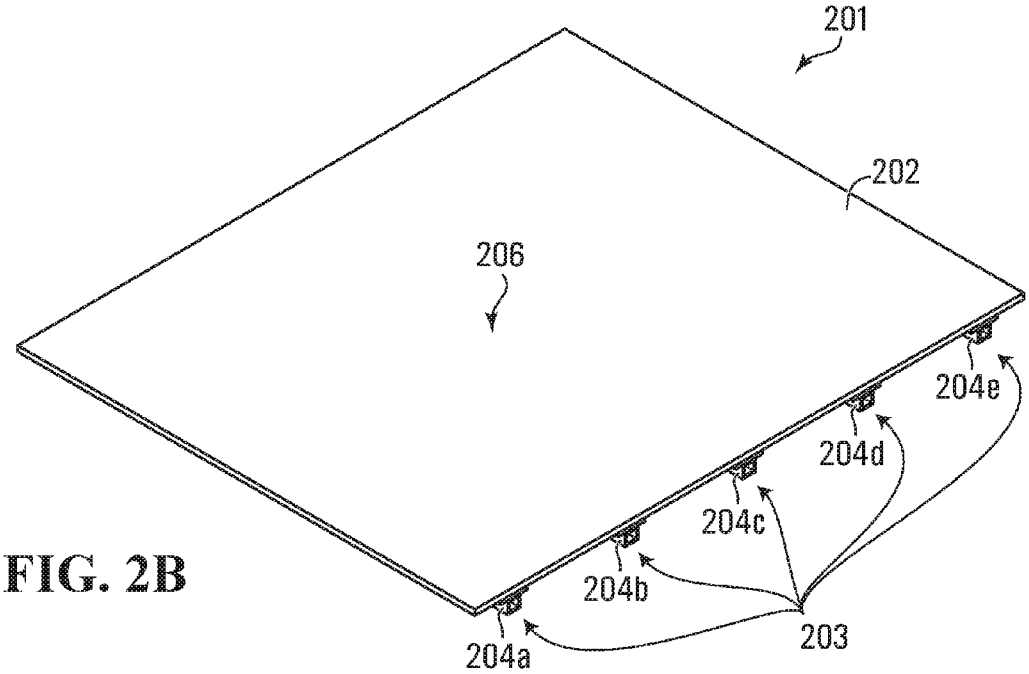

FIGS. 2A and 2B are perspective views showing a configuration of a pallet 201 that may be used for the first pallet 401, the second pallet 501 or both the first and second pallets 401 501 of an assembly of stacked mattresses of the type shown in FIG. 1 in accordance with a first embodiment of the invention.

FIG. 2A shows a perspective view of a first surface 207 of the pallet 201 and FIG. 2B shows a perspective view of a second surface 206 of the pallet 201.

As depicted, the pallet 201 includes a supporting member 202 and a plurality of elongated reinforcing members 203 (where $\mathbf{203}_x$, denote a specific elongated reinforcing member from the plurality of elongated reinforcing members 203) extending across the supporting member 202. In this example, the supporting member 202 has a first surface 207 and a second surface 206 and the plurality of elongated reinforcing members 203 are attached to the first surface 207 of the supporting member 202. In FIGS. 2A and 2B five elongated reinforcing members $\mathbf{203}_a$, $\mathbf{203}_b$, $\mathbf{203}_c$, $\mathbf{203}_d$, and $\mathbf{203}_e$, are shown; however, it is to be appreciated that the number of reinforcing members on a pallet may be more or less than five in alternative implementations of the invention. In practical implementations, a pallet having two or more elongated reinforcing members will be preferred.

The supporting member 202 may be made, for example, at least in part of wood, plastic, metal, and/or any other suitable material. More specifically, in some embodiments, the supporting member 202 may be made at least in part of wood-based materials which may include one or wooden planks, plywood planks, boards and the like. The supporting member 202 may have a surface area that is substantially similar to a surface area of an individual mattress 301 in the stack of mattresses 302 in order to distribute the pressure exerted by the compressed mattresses over the surface of the supporting member 202. In specific practical implementations, the supporting member 202 may have a substantially rectangular shape generally corresponding to the shaped the mattresses being shipped. In specific practical implementations, the supporting member 202 may be a single sheet of plywood or a single sheet of medium-density fiberboard (MDF) that has dimensions (length and width) substantially similar to the dimensions of the mattress 301. In implementations in which the supporting member 202 is a single sheet of plywood or medium density fiberboard, the single sheet of plywood or medium density fiberboard may have any suitable thickness. In non-limiting implementations, a sheet of plywood having a thickness in the range of ¼ inch to 2 inches may be used. It is noted that the reinforcing members 204 increase the tensile strength of such a sheet of plywood and therefore permit a sheet of plywood of a lesser thickness to be used without compromising the solidity of the pallet 201.

As shown in FIG. 2A, the pallet 201 includes a plurality of elongated reinforcing members 203 extending across the supporting member 202. The elongated reinforcing members 203 may be made of wood, plastic, metal, and/or any other suitable material. The elongated reinforcing members 203 may be positioned alongside one another in a spaced-apart relationship over the surface 207 of the supporting member 202 in the manner depicted in FIG. 2A for example.

At least some of the elongated reinforcing members 203 include respective strap guiding members 204 extending longitudinally along the elongated reinforcing member 203. While all the reinforcement members shown in FIG. 2A include strap guiding members 204 it is to be appreciated that in alternative embodiment only some reinforcing member 203 may include strap guiding members 204. As such, the number of strap guiding members 204 need not be the same as the number of reinforcing members 203. In the embodiment illustrated in FIGS. 2A and 2B, five strap guiding members $\mathbf{204}_a$, $\mathbf{204}_b$, $\mathbf{204}_c$, $\mathbf{204}_d$, and $\mathbf{204}_e$, are shown; however, it is to be appreciated that the number of strap guiding members may be more or less than five in alternative implementations of the invention. In practical implementations, a pallet having two or more strap guiding members will be preferred.

The strap guiding members 204 may be configured to receive and guide one or more straps 510 (not shown in FIGS. 2A and 2B—shown in FIG. 1) over the surface 207 of the supporting member. At least some of the straps 510 engage respective ones of the strap guiding members 204 of the plurality of elongated reinforcing member 203 of the pallet 201. In other words, the strap guiding members 204 may be configured to receive and guide one or more straps 510 longitudinally along the reinforcing members 203. In the embodiment depicted in FIGS. 2A and 2B, the strap guiding members 204 are comprised of hollow tubular portions extending longitudinally along the reinforcing members 203. In the cases where the strap guiding members 204 comprises hollow tubular portions, at least some of the straps 510 pass through at least some of the hollow tubular portions.

The hollow tubular portions may be of a generally square, rectangular, semi-circular cross-sectional shape or of any other suitable shape. For example, the strap guiding members 204 may be A500 grade steel structural square tubes having a height of 2 inches, width of 2 inches and a wall thickness of ⅛ of an inch. However, the dimensions of the strap guiding members 204 are not limited to the example given above and any suitable dimension and cross-section may be used. By way of an example, the strap guiding members 204 may be made at least in part of metal, plastic or wood square or rectangular tubes having a height in the range of ½ an inch to 4 inches, a width in the range of in the range of ½ an inch to 4 inches and a wall thickness in the range of 0.065 of an inch to ½ an inch.

The elongated reinforcing members 203 may be fastened to the surface 207 of supporting member 202 using any suitable fastener or any suitable binding material. For example, the plurality of elongated reinforcing members 203 may be fastened to the supporting member 202 by one or more screws, nails, tacks, brackets or any other suitable mechanical fastener. In alternative embodiments, the reinforcing members 203 may be bound to the supporting member 202 using a glue, an adhesive or any suitable chemical binder. In the non-limiting embodiment depicted in FIGS. 2A and 2B, the reinforcing members 203 includes interface members 205 for fastening to the supporting member 202. The interface members 205 may be positioned between the strap guiding members 204 and the supporting member 202 and may facilitate the fastening or binding of the reinforcing members 203 to the supporting member 202 during assembly of the pallet 201. The one or more interface members 205 may be comprised of elongated strips of plastic, wood, metal, and/or any other suitable material.

Figure 3:
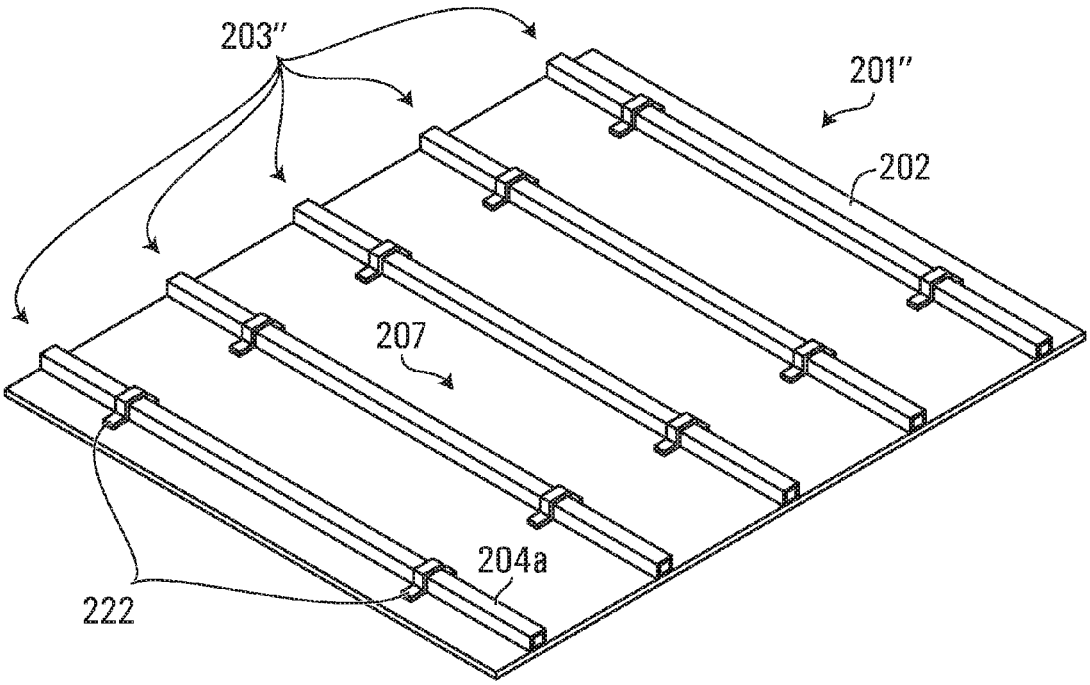
FIG. 3 is perspective views of a variant of the pallet depicted in FIGS. 2A and 2B.

FIG. 3 shows a pallet 201", which is a variant of pallet 201 shown in FIGS. 2A and 2B, in which the elongated reinforcing members 203" are fastened to the surface 207 of supporting member 202 using a set of brackets or braces 222 positioned at different locations along the length of the respective elongated reinforcing members 203". The brackets or braces 222 may be made of any suitable material, such as metal, steel or nylon strapping.

Figure 2C:
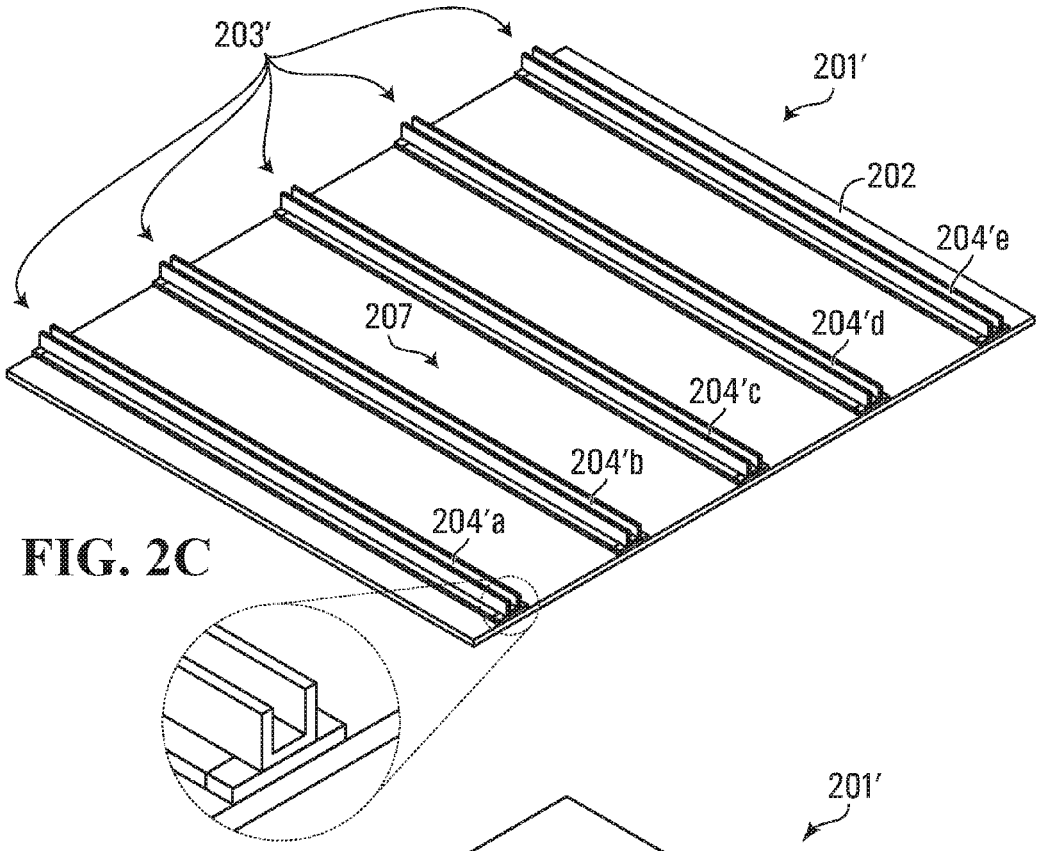
FIGS. 2C and 2D are perspective views of a pallet suitable for use in an assembly of the type shown in FIG. 1 in accordance with a second embodiment of the invention.
Figure 2D:
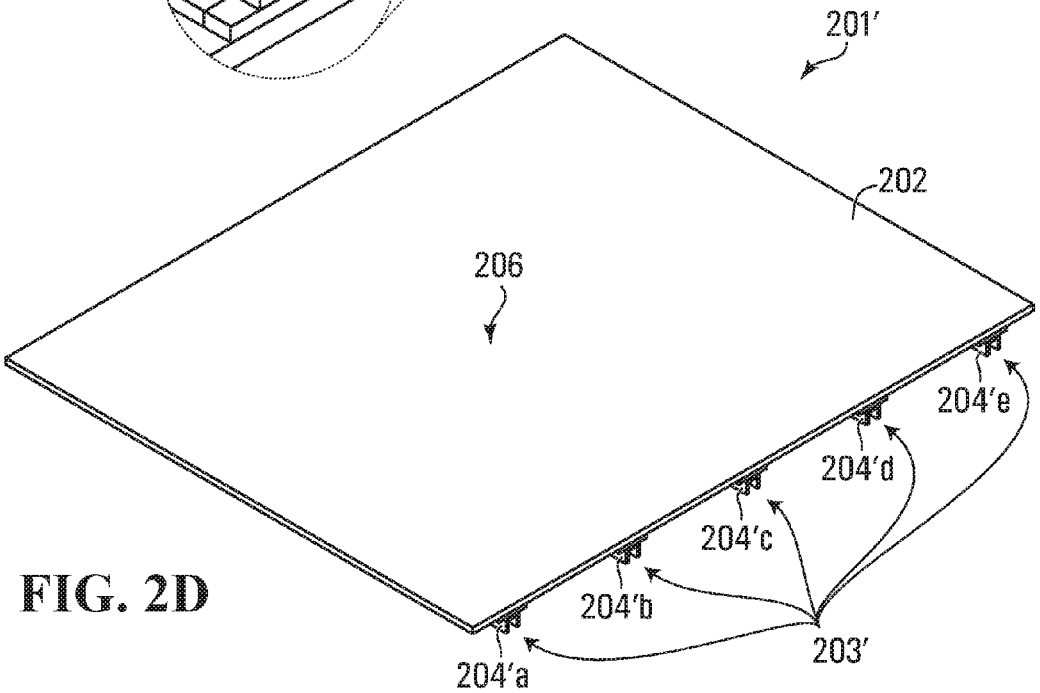

FIGS. 2C and 2D are perspective views of another configuration of a pallet 201' that may be used for the first pallet 401, the second pallet 501 or both the first and second pallets 401 and of an assembly of the type shown in FIG. 1 in accordance with a second embodiment of the invention. In this alternative configuration, the pallet 201' has some components similar to the components of pallet 201 shows in FIGS. 2A and 2B. For ease of understanding, the components that are common to the two configurations have been given the same reference numerals.

As depicted, the pallet 201' includes a supporting member 202 and a plurality of elongated reinforcing members 203' extending across the supporting member 202. In this example, the supporting member 202 has a first surface 207 and a second surface 206 and the plurality of elongated reinforcing members 203' are attached to the first surface 207 of the supporting member 202. As shown in FIG. 2C, the pallet 201' includes a plurality of elongated reinforcing members 203' extending across the supporting member 202. The elongated reinforcing members 203' may be made of wood, plastic, metal, and/or any other suitable material and may be fastened to the supporting member 202 in a manner similar to the fastening of elongated reinforcing members 203 described with reference to the embodiment of FIGS. 2A and 2B. The elongated reinforcing members 203' may be positioned alongside one another in a spaced-apart relationship over the surface 207 of the supporting member 202. In FIGS. 2C and 2D five elongated reinforcing members $\mathbf{203'}_a$, $\mathbf{203'}_b$, $\mathbf{203'}_c$, $\mathbf{203'}_d$, and $\mathbf{203'}_e$, are shown however, it is to be appreciated that the number of reinforcing members on a pallet may be more or less than five in alternative implementations of the invention. In practical implementations, a pallet having two or more elongated reinforcing members will be preferred.

At least some of the elongated reinforcing members 203' include respective strap guiding members 204' extending longitudinally along the elongated reinforcing member 203'. While all the reinforcement members shown in the figure including strap guiding members 204', it is to be appreciated that in alternative embodiment only some reinforcing member 203' may include strap guiding members 204'. As such, the number of strap guiding members 204' need not be the same as the number of reinforcing members 203'.

The strap guiding members 204' may be configured to receive and guide one or more straps 510 (not shown in FIGS. 2C and 2D—shown in FIG. 1) over the surface 207 of the supporting member 202. At least some of the straps 510 engage respective ones of the strap guiding members 204' of the plurality of elongated reinforcing member 203' of the pallet 201. In other words, the strap guiding members 204' may be configured to receive and guide one or more straps 510 longitudinally along the reinforcing members 203'.

In this embodiment, at least some of the strap guiding members 204' are comprised of U-shaped portions extending longitudinally along the reinforcing members 203'. The U-shaped portions are configured for receiving therein one or more straps 510 (not shown in FIGS. 2C and 2D). The U-shaped portions may be of a generally triangular, square, rectangular or semi-circular cross-sectional shape having an opening forming a channel for receiving therein one or more straps. The strap guiding members 204' may be made of any suitable material including metal, plastic or wood and may be of any suitable dimension for receiving therein one or more straps. In a specific implementation, the U-shaped channels may have a width in the range of ½ an inch to 4 inches, a leg or flange height in the range of in the range of ½ an inch to 4 inches and a wall or web thickness in the range of an ⅛ of an inch to ½ an inch.

Although in FIGS. 2A to 2D the elongated reinforcing members 203 203' have been illustrated as unitary components that traverse the supporting member 202, it will be appreciated that this need not be the case in all embodiments. For example, each reinforcing members 203 203' may be formed by multiple (2 or more) elongated reinforcing member segments arranged substantially end to end to traverse the surface of supporting member 202.

In addition, while the embodiments depicted in FIGS. 2A, 2B, 2C and 2D show the strap guiding members 204 204' as being either hollow tubular portions or U-shaped portions, it is to be appreciated that, in other alternative implementations (not shown in the Figures), at least some of the strap guiding members may be comprised of a combination of hollow tubular portions and U-shaped portions positioned end-to-end across the surface of the supporting member. In such an alternative configurations, the hollow tubular portions of the strap guiding members may prevent straps engaged in the strap guiding members from being displaced.

Figure 2E:
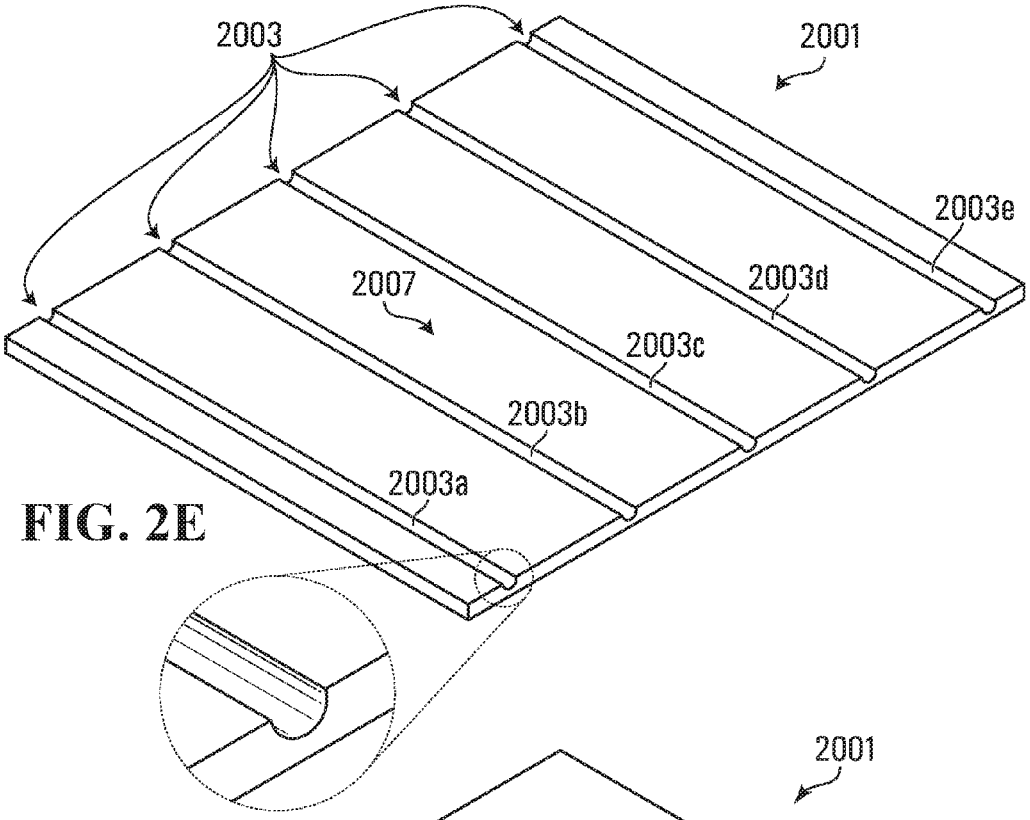
FIGS. 2E and 2F are perspective views of a pallet suitable for use in an assembly of the type shown in FIG. 1 in accordance with a third embodiment of the invention.
Figure 2F:
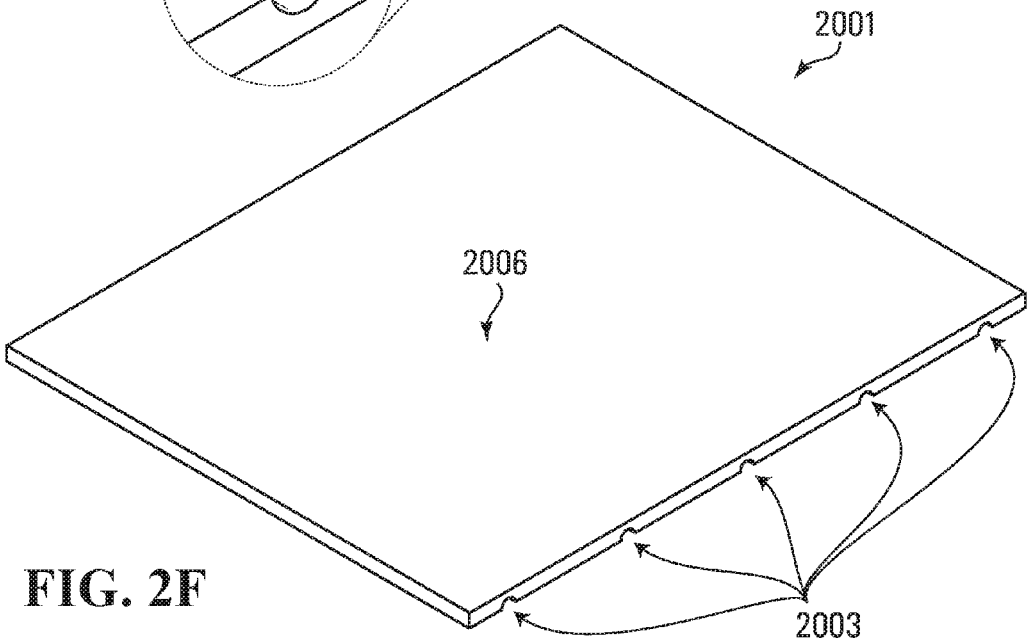

FIGS. 2E and 2F are perspective views of a variant of the pallets shown in FIGS. 2A, 2B, 2C and 2D and which may be used for the first pallet 401, the second pallet 501 or both the first and second pallets 401 and of an assembly of the type shown in FIG. 1 in accordance with a third embodiment of the invention. In this alternative configuration, the plurality of reinforcing members 203 203' including strap guiding members 204 204' are replaced by a plurality of elongated grove members 2003. More specifically, as depicted, the pallet 2001 includes a supporting member 2002 in which a plurality of elongated grove members 2003 extending across the supporting member 2002 have be defined. In this example, the supporting member 2002 has a first surface 2007 and a second surface 2006 and the plurality of elongated grove members 2003 are formed on the first surface 2007 of the supporting member 2002. As shown in FIG. 2E, the pallet 2001 includes a plurality of elongated grove members 2003 extending across the supporting member 2002. The elongated grove members 2003 may be positioned alongside one another in a spaced-apart relationship over the surface 2007 of the supporting member 2002. In FIGS. 2E and 2D five elongated grove members 2003$_a$, 2003$_b$, 2003$_c$, 2003$_d$, and 2003$_e$, are shown; however, it is to be appreciated that the number of grove members on a pallet may be more or less than five in alternative implementations of the invention. In practical implementations, a pallet having two or more elongated grove members will be preferred.

The elongated grove members 2003 are configured for receiving and guiding one or more straps 510 (not shown in FIGS. 2D and 2E) over the surface 2007 of the supporting member 2002. At least some of the straps engage respective ones of the elongated grove members 2003 of the pallet 2001. In other words, the elongated grove members 2003 may be configured to receive and guide one or more straps 510 longitudinally along the reinforcing members 2003.

In this embodiment, at least some of the elongated grove members 2003 are formed as U-shaped portions extending longitudinally along the reinforcing members 2003. The U-shaped portions are configured for receiving therein one or more straps (not shown in FIGS. 2C and 2D). The U-shaped portions may be of a generally triangular, square, rectangular or semi-circular cross-sectional shape having an opening forming a channel for receiving therein one or more straps. The elongated grove members 2003 may be formed directly on the surface of the supporting member 2002 by using any suitable machining technique and may be of any suitable dimension for receiving therein one or more straps.

In a specific implementation, the supporting member 2002 may be made of may be made, for example, at least in part of wood, plastic, metal, and/or any other suitable material and the elongated grove members 2003 are formed within the surface of the supporting member 2002. In a specific implementation, the U-shaped channels may have a width in the range of ½ an inch to 6 inches and a leg or flange height in the range of in the range of ½ an inch to 2 inches. It is noted that the leg or flange height will depending on the thickness of the supporting member 2002. Optionally, portions of the elongated grove members 2003 may be covered (not shown in the figures) to prevent straps engaged in the grove members 2003 from being displaced once the assembly of mattresses is formed.

Returning now to the embodiment depicted in FIG. 1, the first pallet 401 and/or the second pallet 501 may be constructed or may comprise any of the embodiments discussed above regarding the pallet 201, 201', 2001 and/or 201" described with reference to FIGS. 2A, 2B, 2C, 2D, 2E and 2F and 3. It is to be appreciated that, in practical implementations, the first pallet 401 and the second pallet 501 need not be identical to each other. For instance, the first pallet 401 may be made according to the embodiment depicted in FIGS. 2A and 2B and the second pallet 501 may be made according to the embodiment depicted in FIGS. 2C and 2D. Furthermore, as can be seen from the discussion above, the first pallet 401 and the second pallet 501 may be made of wood, plastic, metal, other suitable materials and/or any combination of these aforementioned materials. Alternatively still, the first pallet 401 or the second pallet 501 may be a standard shipping pallet or skid of the type known in the art, for example of the type described ISO Standard 6780: "Flat pallets for intercontinental materials handling—Principal dimensions and tolerances", while the other pallet may be made according to one the embodiments described previously with reference to FIGS. 2A, 2B, 2C, 2D, 2E, 2F and 3.

Figure 4:
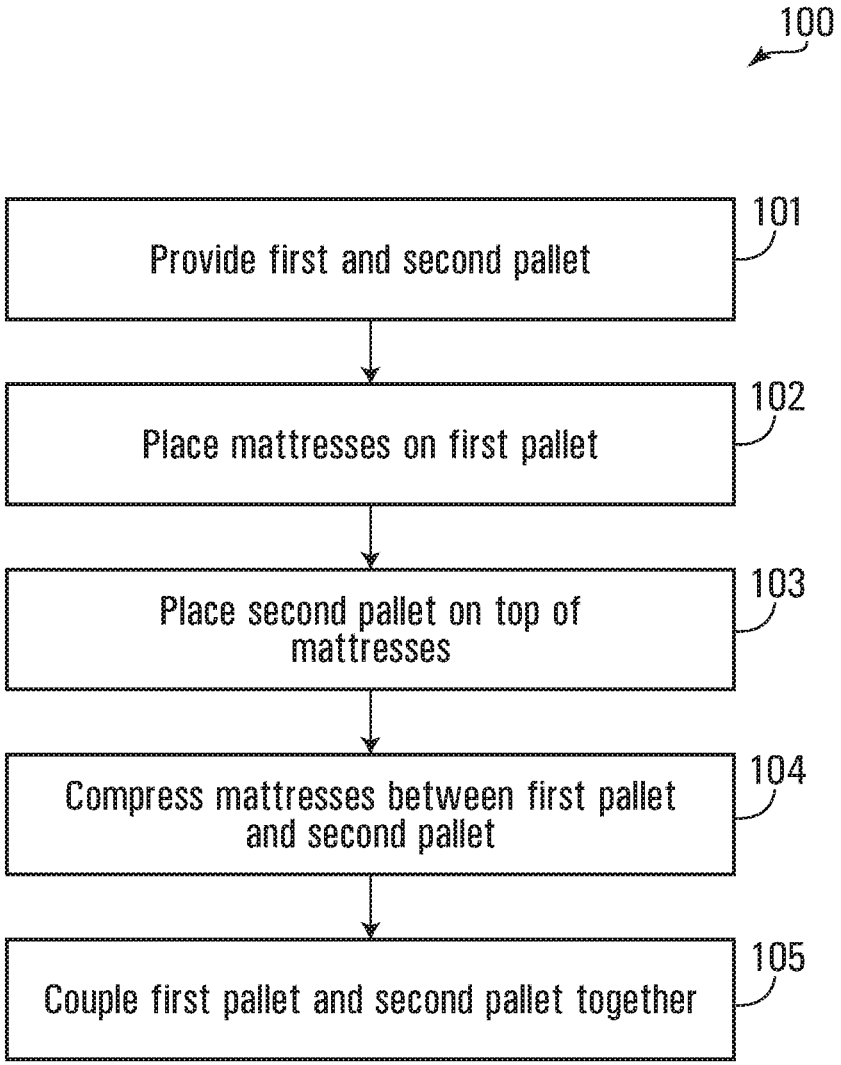
FIG. 4 is a flowchart of a method for preparing an assembly of mattresses of the type depicted in FIG. 1 in accordance with a specific example of implementation of the invention.

FIG. 4 is a flowchart showing a method 100 that may be used for preparing an assembly of stacked mattresses of the type depicted in FIG. 1.

As shown, at step 101, a first pallet 401 and a second pallet 501 are provided. Next at step 102, mattresses are stacked upon the first pallet 401. Then, at step 103 the second pallet 501 is placed on top of the plurality of stacked the mattresses. At step 104 the mattresses between the first pallet 401 and the second pallet 501 are compresses to reduce the height of the stack of mattresses. Then, at step 105, the first pallet 401 and the second pallet 501 are coupled together to restrain expansion of the compressed mattresses 302. The coupling of the first pallet 401 to the second pallet 501 may be done using any suitable mechanism such as for example by using straps 510. Once the first pallet 401 and the second pallet 501 are coupled together, the assembly of mattresses 790 may be placed within a container (not shown) and may be transported to a desired destination, via rail, ship or truck for example. Each of the steps of the method 100 will now be discussed in more detail with reference to FIGS. 5, 6, 7 and 8A to 8E.

At step 101, a first pallet 401 and a second pallet 501 are provided. The first pallet 401 and/or the second pallet 501 may be constructed according to any of the embodiments discussed above regarding the pallet 201, 201', and/or 201". For the purpose of the present example, the process described will consider that both the first pallet 401 and the second pallet 501 are constructed in the manner described with reference to pallet 201 described with reference to FIGS. 2A and 2B.

Figure 5:
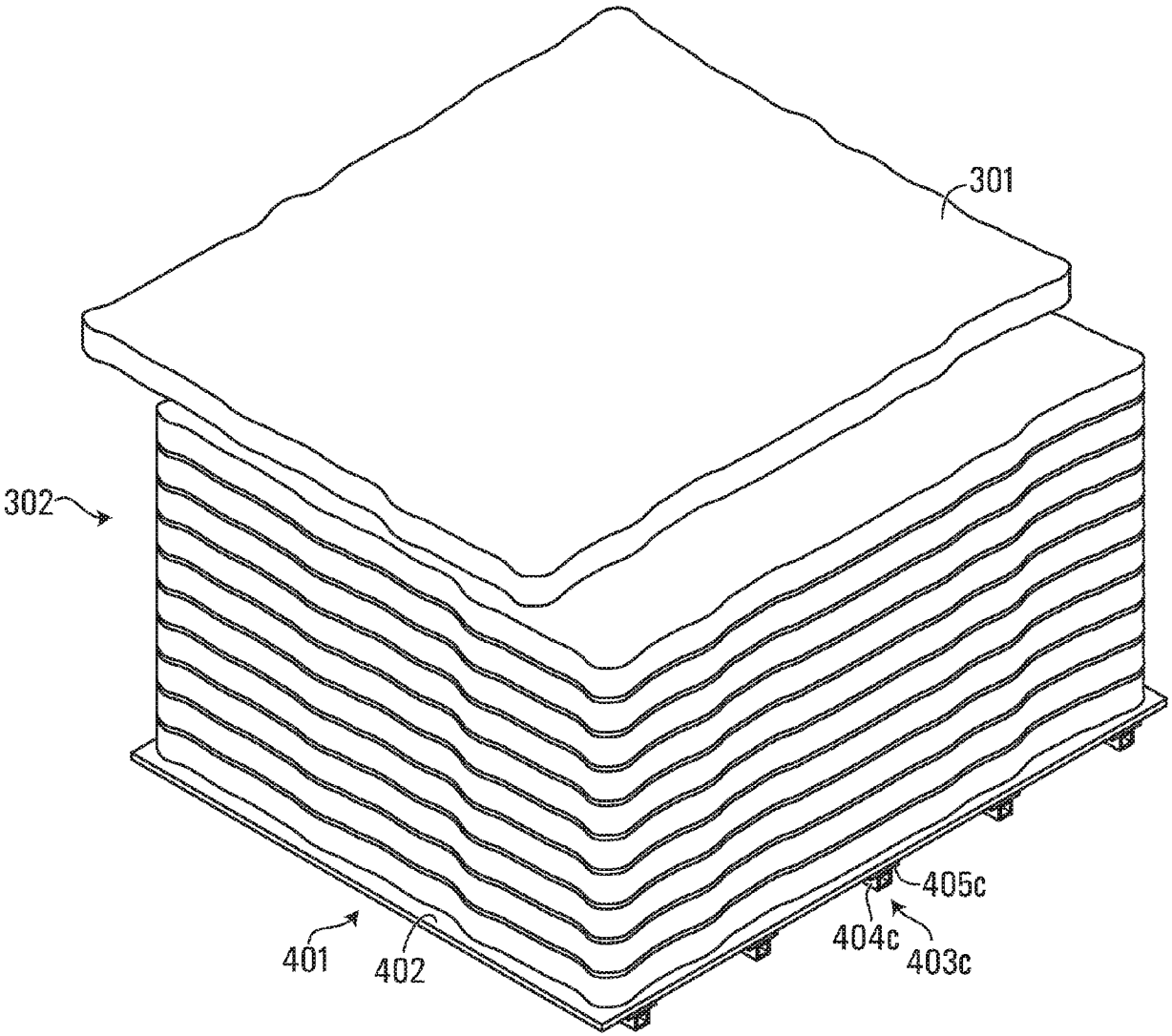
FIG. 5 is a perspective view of a first pallet on which a plurality of mattresses has been stacked in accordance with a specific example of implementation of the invention.

At step 102 of the method 100, mattresses are stacked on the first pallet 401, which is illustrated in the perspective view shown in FIG. 5. In this specific embodiment, the first pallet 401 is a lower pallet and several individual mattresses 301 are placed on the first pallet 401 to form a stack of mattresses 302. Optionally, each of the individual mattresses 301 may have been previously compressed prior to being placed upon the first pallet 401. For example, the compression of the individual mattress 301 prior to stacking on the first pallet 401 may follow the suggested approach described in U.S. Pat. No. 7,458,093 and U.S. Pat. No. 7,895,813.

Figure 6:
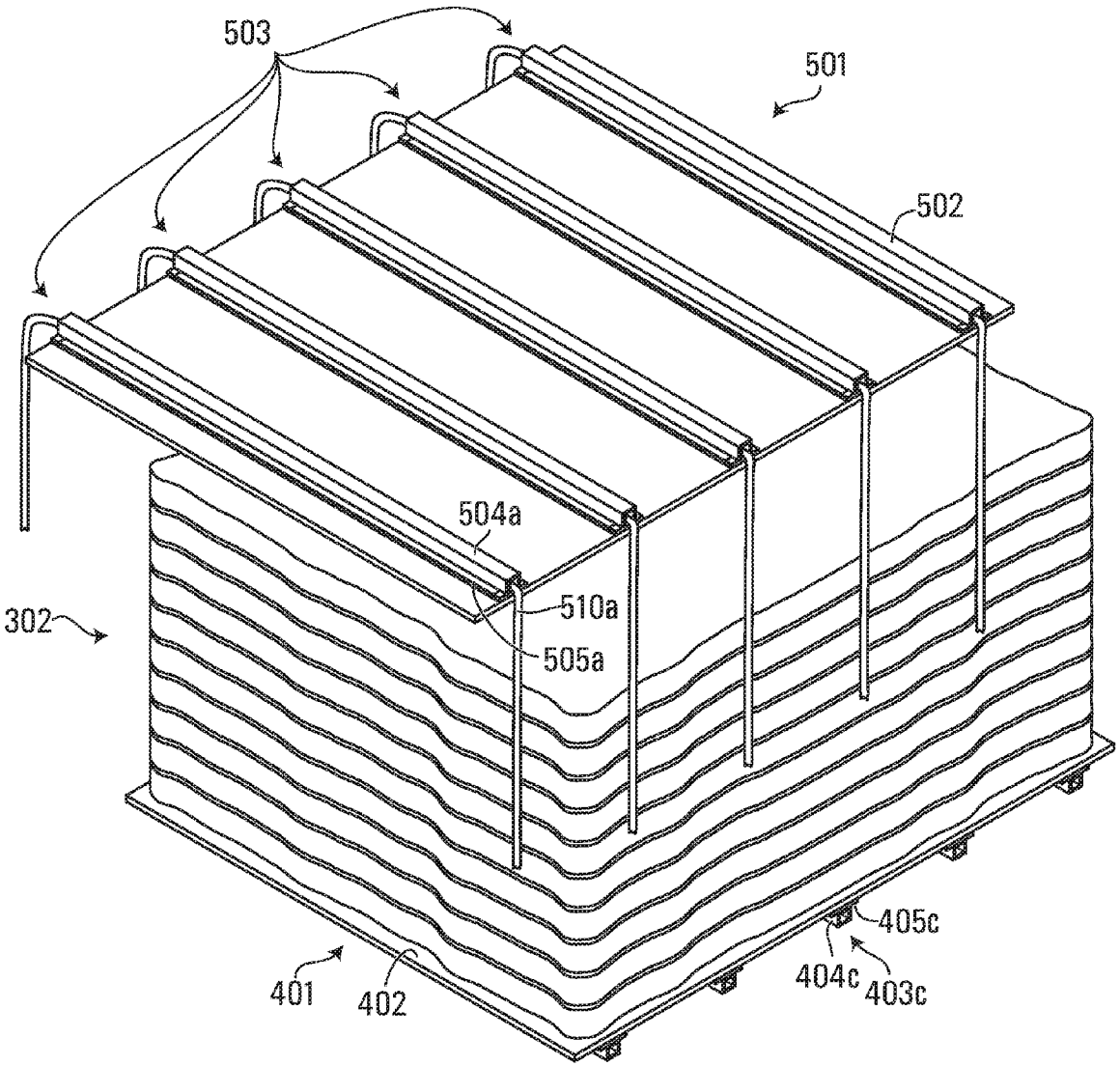
FIG. 6 is a perspective view of the first pallet of FIG. 5, on which a plurality of mattresses has been stacked, where a second pallet is being placed on top of the plurality of mattresses in accordance with a specific example of implementation of the invention.

Following this, at step 103 of the method 100, a second pallet 501 is placed upon the stack of mattresses 302, which is illustrated in the perspective view shown in FIG. 6. In this example, the second pallet 501 is shown with straps 510 having been passed through the respective strap guiding members 504.

Optionally, protective materials may be used to protect the mattresses from the first pallet 401 and/or the second pallet 501. This variant is illustrated in the perspective view shown in FIG. 7. As shown, protective materials 604 and/or 608 are placed on top of and below the stack of mattresses 302 to protect the mattresses from the first and second pallets 401 501. In this example, the upward facing surface of the first pallet 401 is covered with a protective material 604, such as, but not limited to corrugated cardboard, packaging paper, plastic wrapping and/or any other suitable material. Similarly, the top of the plurality of mattresses 302 is also covered with a protective material 608, such as, but not limited to corrugated cardboard, packaging paper, plastic wrapping and/or any other suitable material.

Figure 7:
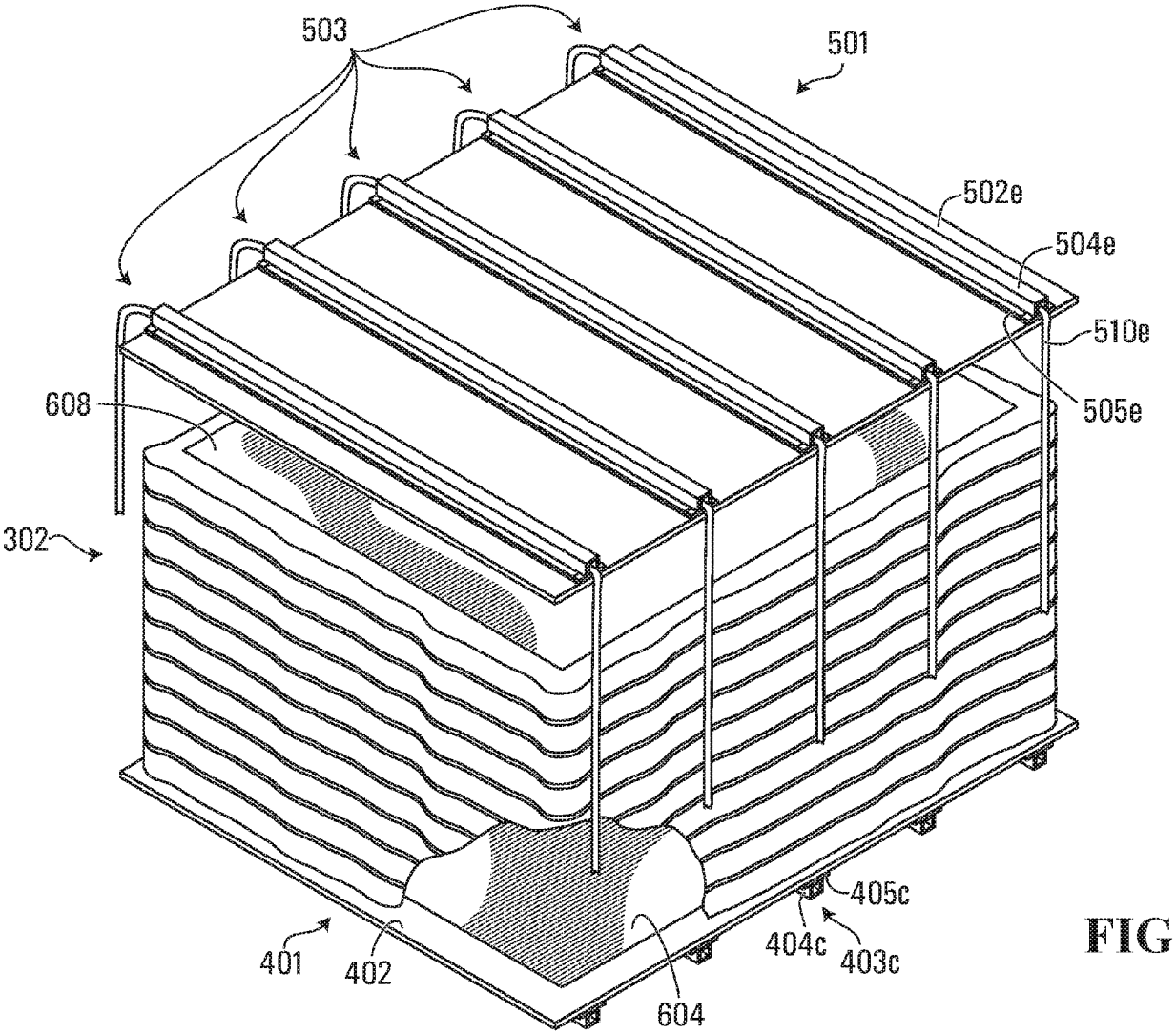
FIG. 7 is a variant of FIG. 6 in which protective material has been used to protect the mattresses.

Optionally still, not shown in FIGS. 6 and 7, protective strips 910 (shown in FIG. 1) and/or a protective cover 908 (also shown in FIG. 1) may also be added to protect the stack of mattresses 302.

For example, a protective cover 908, such as a protective sheath, may be used to cover the periphery of the stack of mattresses 302. The protective cover 908 may be wrapped around the sides of the stack of mattresses 302 and between the upper or second pallet 501 and the lower or first pallet 401. Such protective sheath may be made of any suitable material such as corrugated cardboard, packaging paper, plastic wrapping and/or any other suitable material, to further protect the mattresses. The protective cover 908 may be made of the same material as the protective material 604 and 608 used to protect the top and bottom of the stack of mattresses 302 from the respective second pallet 501 and first pallet 401 or may be a different material.

Optional protective strips 910 may be positioned on the sides of the stack of compressed mattresses 302. The optional protective strips 910 may be made of any suitable material which may include, without being limited to, polyurethane foam or felt padding. The protective strips 910 may be positioned generally along the sides of the stack of mattresses 302 between the upper or second pallet 501 and the lower or first pallet 401. More specifically, in some embodiments, the protective strips may be positioned to be generally aligned with the strap guiding members 404 and strap guiding members 504. Moreover, in some embodiments, the protective strips 910 may be paced on top of the protective cover 908, while in other embodiments the protective cover 908 may overlay the protective strips 910. (For examples of embodiments illustrating the protective strips 910 and protective cover 908 see FIGS. 1 and 10).

After the second pallet 501 has been placed upon the stack of mattresses 302, the process proceeds to step 104.

At step 104 of the method 100, the stack of mattresses 302 between the first pallet 401 and the second pallet 501 is compresses in order to reduce the height of the stack of mattresses. FIGS. 8A to 8E illustrate an example, in accordance with a non-limiting embodiment of the present invention, of a process for compressing the stack of mattresses 302 and a device for effecting such compressing. For the purpose of simplifying the description, in FIGS. 8A to 8E the combination including the stack of mattresses 302, the first pallet 401 and the second pallet 501 will be designated as a group as assembly 700.

Figure 8A:
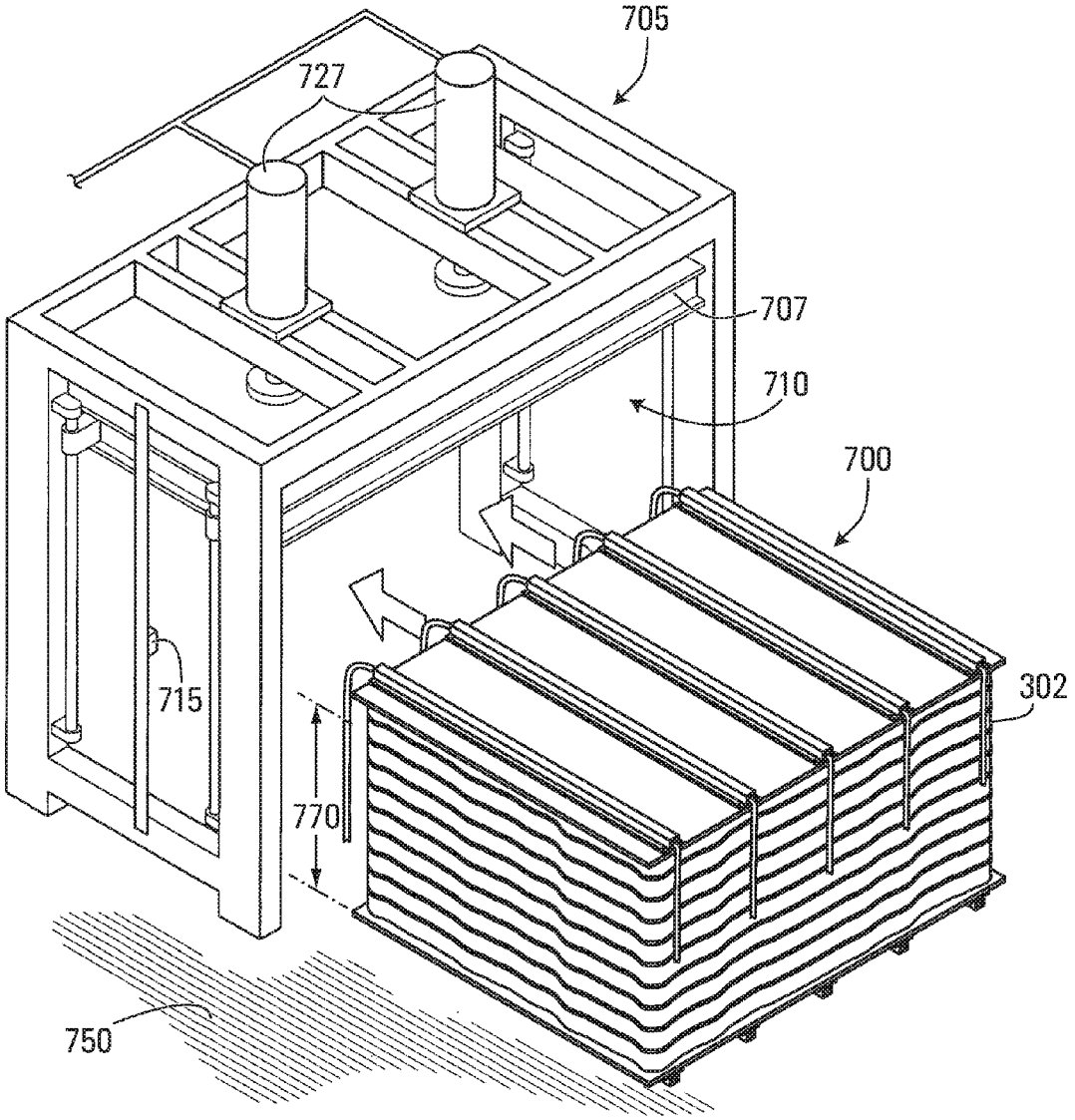
FIG. 8A shows a plurality of mattresses positioned between a first pallet and a second pallet prior to being placed within a press for compressing the plurality of mattresses in accordance with an embodiment of the present invention.
Figure 8B:
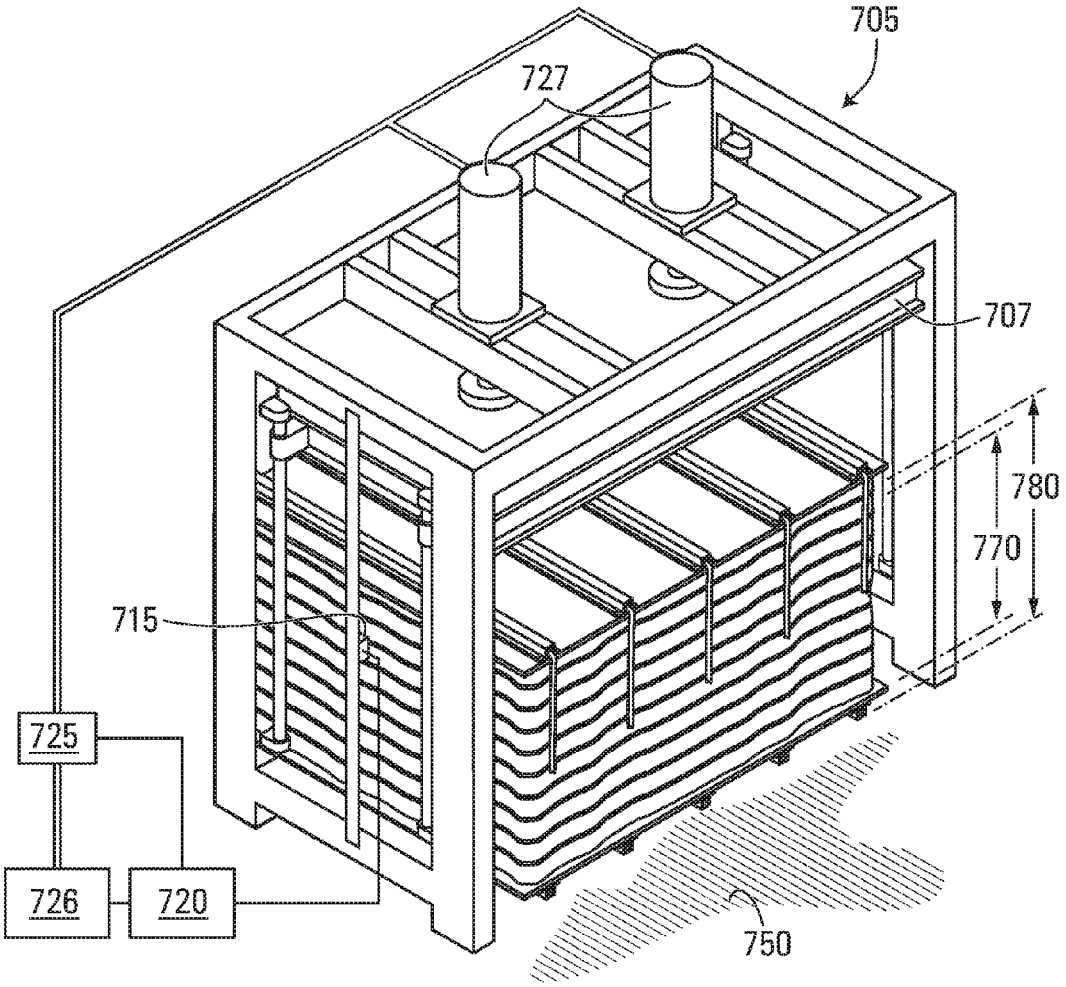
FIG. 8B shows the plurality of mattresses of FIG. 8A positioned within the press.

FIGS. 8A and 8B illustrate, in accordance with an embodiment of the present invention, placing the assembly 700 within a press 705, possibly, but not limited to, a hydraulic press employing a vertical hydraulic press plate 707. The press 705 comprises a sensor 715 that is coupled to a controller 720 and that detects the position of the press plate 707 when the mattress stack 302 has been squeezed to a predetermined set height 770. The controller 720 is coupled to at least one hydraulic actuator 727, coupled to the press plate 707 and capable of raising and lowering the press play 707.

Figure 8C:
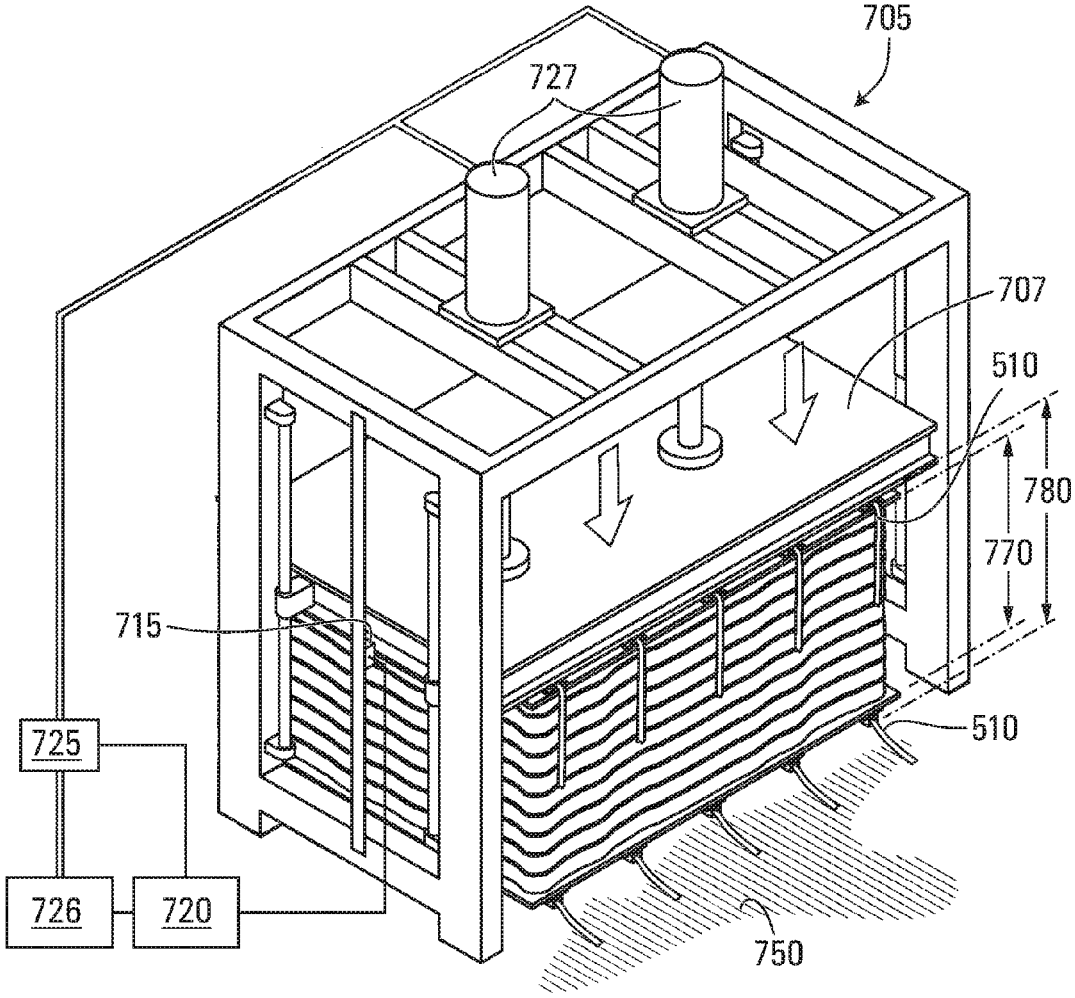
FIG. 8C shows the plurality of mattresses of FIG. 8A being compressed by the press.

FIG. 8C illustrates, in accordance with an embodiment of the present invention, lowering the press plate 707 and compressing the stack of mattresses 302 to the stack predetermined-set height 770. As the press plate 707 is lowered, an opening 710 between the press plate 707 and a floor 750 is reduced, thereby compressing the stack of mattresses 302 resting upon the lower of first pallet 401, which, in turn, rests upon the floor 750, to the stack predetermined-set height 770. When the press plate 707 reaches a position 770 corresponding to the height of the stack of mattresses 302 reaching the stack predetermined-set height 780 and resulting in a compressed assembly of mattresses 790, a signal from the position sensor 715 to the controller 720 results in a halt to vertical movement of the press plate 707. FIG. 8C also illustrates, in accordance with an embodiment of the present invention, locking the press plate 707 in position and passing one or more straps 510 through each of the strap guiding members 404 of the first pallet 401 and through each of the strap guiding members 504 of the second pallet 501. FIG. 8C also shows at least some of the straps 510 engaging respective ones of the strap guiding members 504 of the plurality of elongated reinforcing member 503 of the second pallet 501. FIG. 8C also shows at least some of the straps 510 engaging respective ones of the strap guiding members 404 of the plurality of elongated reinforcing member 403 of the first pallet 401.

After the assembly 700 has been compressed, the process proceeds to step 105.

Figure 8D:
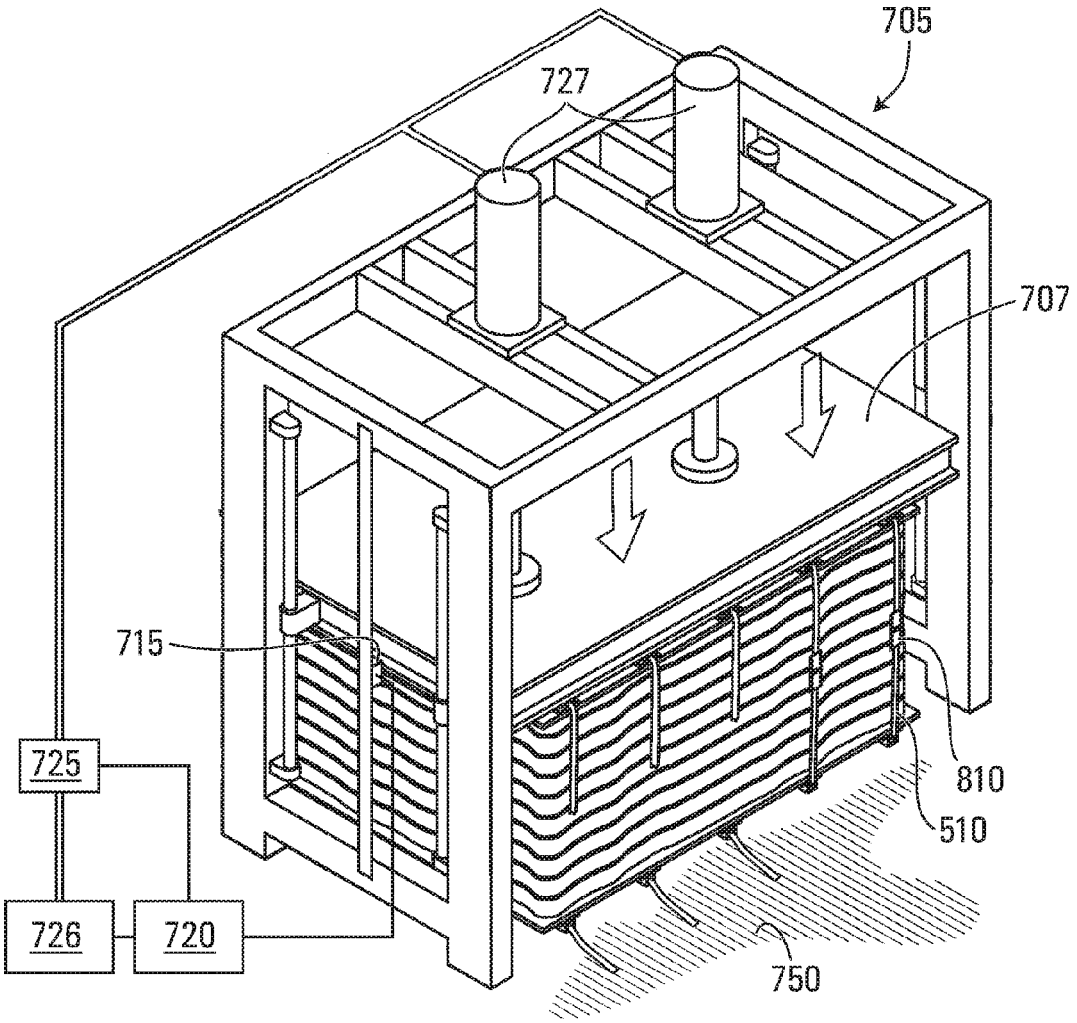
FIG. 8D shows the plurality of mattresses of FIG. 8A wherein the first and second pallets are being coupled to one another using straps.

At step 105 of the method 100, the first pallet 401 and the second pallet 501 are coupled together to restrain expansion of the plurality of mattresses and to maintain the stack of mattresses 302 in a compressed state and at substantially the stack predetermined set height 770. FIG. 8D illustrates, in accordance with an embodiment of the present invention, the first and second pallets 401 501 being coupled together using a plurality of straps 510.

In the specific example shown in the Figures, for each of the strap guiding members 503 on the second pallet 501 there is a corresponding strap guiding members 403 on the first pallet 401 in which at least one of the straps 510 passes through. In accordance with a specific and non-limiting example, in the case where the first pallet member 401 has strap guiding members $\mathbf{404}_a$, $\mathbf{404}_b$, . . . and $\mathbf{404}_e$, and the second pallet member 501 has strap guiding members $\mathbf{504}_a$, $\mathbf{504}_b$, . . . and $\mathbf{504}_e$, then straps $\mathbf{510}_a$, $\mathbf{510}_b$, . . . and $\mathbf{510}_e$ may engage respective strap guiding members. For example, strap $\mathbf{510}_a$, may engage strap guiding members $\mathbf{404}_a$, and $\mathbf{504}_a$, strap $\mathbf{510}_b$ may engage strap guiding members $\mathbf{404}_b$ and $\mathbf{504}_b$, and so forth.

Figure 9:
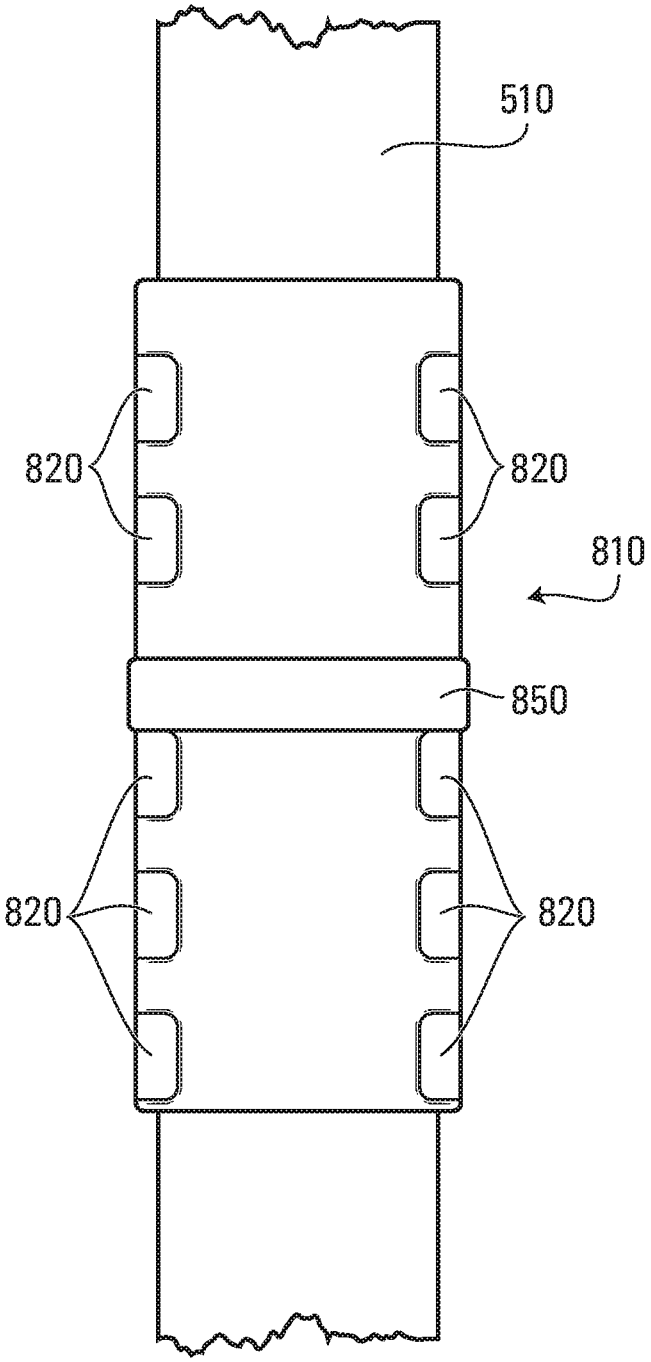
FIG. 9 shows a coupling device fastening a strap used for coupling the pallets of an assembly of mattresses of the type depicted in FIG. 1 in accordance with a specific embodiment of the present invention.

Depending on the type of straps used, ends of the straps may be coupled together with a connector or coupling device. FIG. 9 illustrates, in accordance with an embodiment of the present invention, a coupling device 810 that may be used to connecting the two ends of a strap 510 together. The coupling device 810 may be embodied in any suitable device including for example a metal strapping joint, a buckle or any other mechanism. In the specific example shown in FIG. 9, in this embodiment, the coupling device 810 is a metal strapping joint with a set of notches 820 in order to securely fasten both ends of the strap together. For example, to couple the ends of the strap 510 together, this may be done with a strapping sealer, such as a double notched strapping sealer, or any other suitable mechanical device. Furthermore, a band 850 may also be coupled around the coupling device 810 and the strap 810 to assist in securing the coupling device in place.

Figure 8E:
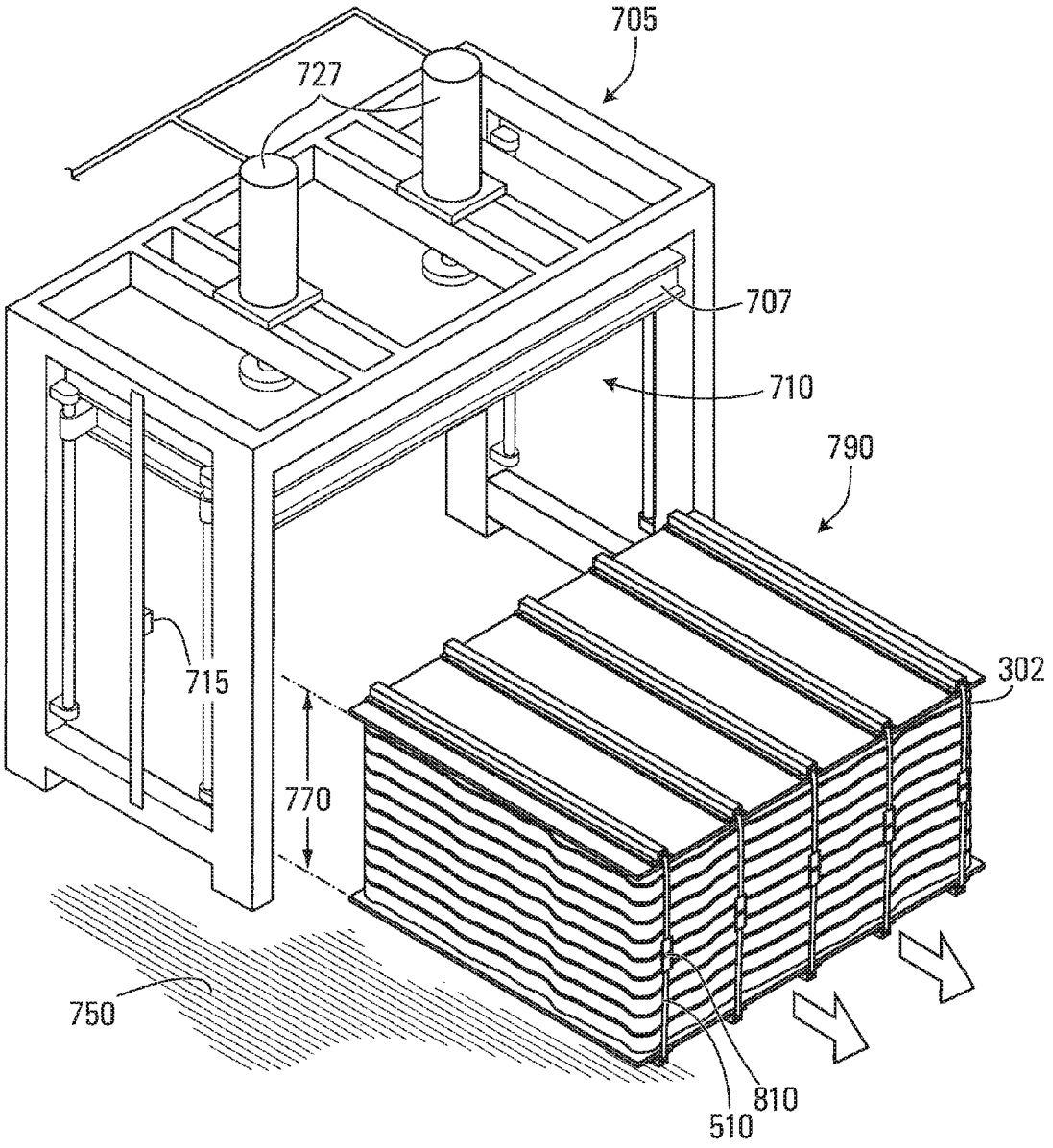
FIG. 8E shows the plurality of mattresses of FIGS. 8A-8D being removed from the press after the step depicted in FIG. 8D.

FIG. 8E illustrates, in accordance with an embodiment of the present invention, after the compressed assembly of mattresses 790 containing the stack of mattresses 30 has been secured or coupled with the straps 510, raising the press plate 707 and removing the secured and compressed assembly of stacked mattresses 790 from the press 705. In non-limiting implementations, the weight of the compressed assembly of mattresses 790 may be kept between substantially 1500 pounds and substantially 2000 pounds for ease of handling. The height of the compressed assembly of mattresses 790 may be kept between substantially 47 inches and substantially 49 inches for ease of handling, loading, and unloading and for safety considerations, including avoidance of a propensity for tipping off when handled with a forklift during storage on a higher section of a warehouse racking system.

The compressed assembly of stacked mattresses 790, as illustrated in FIG. 8E, should preferably not exceed approximately 8 feet in height if to be shipped in a 40 foot Hi Cube container having an internal height of about 8 feet and 10 inches. For conventional 40 foot containers and 20 foot containers having an internal height of substantially 7 feet and 10 inches, the compressed assembly of stacked mattresses 790 should preferably not exceed approximately 7 feet in height. The space left between the height of the compressed assembly of stacked mattresses 790 and the internal height of the container may allow for ease of loading and unloading. In addition, one or more compressed assemblies of stacked mattresses 790 may be stacked upon one another in a shipping container, provided preferably that the total height of the stacked compressed assemblies 790 does not exceed approximately 8 feet in the case of a Hi Cube container.

Weights and dimensions, presented above, have been given for the purpose of example only and practical implementations of the components presented in the present document may use other suitable measurements that may vary from those presented here.

Figure 10:
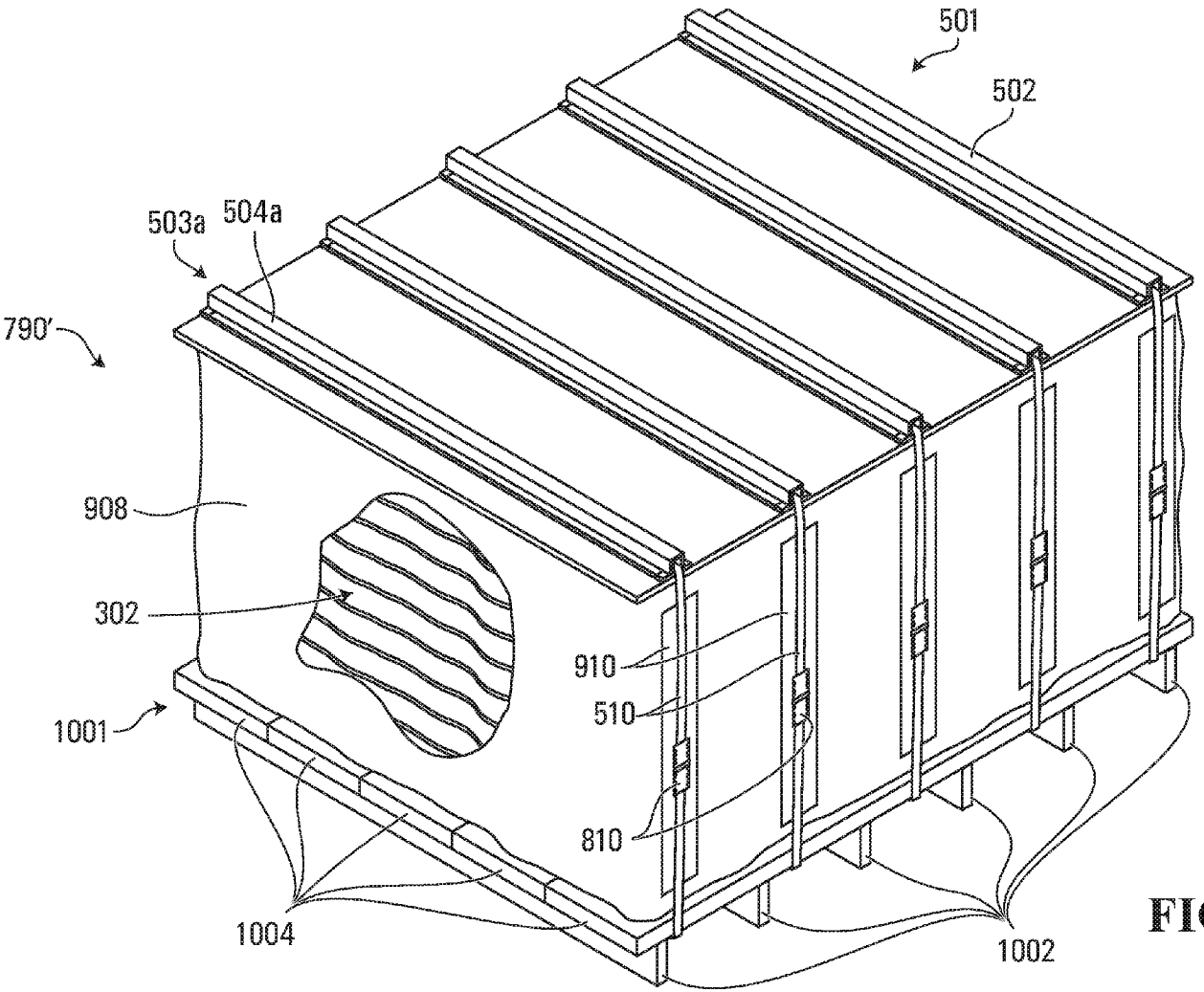
FIG. 10 shows an assembly of stacked mattresses in accordance with a variant of the invention.

Although in some of the embodiments discussed above, the upper and lower pallets are constructed in the same or similar way, this is not necessarily the case for some alternative embodiments of the invention. An example of such an alternative embodiment of an assembly of stacked mattresses is depicted in FIG. 10. As shown, the assembly 790' includes a first pallet 1001, a second pallet 501 and a plurality of mattresses 302 positioned between the first pallet 401 and the second pallet 501. In this example, the first pallet 1001 is a lower pallet and the second pallet 501 is an upper pallet. The assembly 790' is similar to the assembly of stacked mattresses 790 depicted in FIG. 1 with the lower (or first) pallet 1001 having a configuration that is different from the lower (or first) pallet 401 (shown in FIG. 1). More specifically, the lower pallet 1001 in the example depicted is constructed of an array of wooden planks 1004 held in position by another array of wooden crosspieces or crossbars 1002 arranged orthogonally to the array of wooden planks 1004. It will be readily appreciated that other variants are possible and will become apparent to the person skilled in the art in view of the present description.

Certain additional elements that may be needed for operation of some embodiments have not been described or illustrated as they are assumed to be within the purview of those of ordinary skill in the art. Moreover, certain embodiments may be free of, may lack and/or may function without any element that is not specifically disclosed herein.

Although various embodiments and examples have been presented, this was for the purpose of describing, but not limiting, the invention. For example, although in the embodiments discussed above relate to assemblies of stacked mattresses and method for preparing such assemblies, similar assemblies (and method of preparing same) may also be considered for other types of bedding products such as for example mattress covers, bedding foam, pillows, quilts, comforters. Various other modifications and enhancements will become apparent to those of ordinary skill in the art. The invention is defined more particularly by the appended claims.

The invention claimed is:

1. An assembly of stacked mattresses comprising:

a) a first pallet;

b) a second pallet;

c) a plurality of mattresses positioned between the first pallet and the second pallet;

d) straps coupling the first pallet to the second pallet, the plurality of mattresses being in a compressed state between the first pallet and the second pallet and the straps restraining expansion of the plurality of mattresses;

e) wherein the second pallet is comprised of:

i) a supporting member; and ii) a plurality of elongated reinforcing members extending across the supporting member, at least some elongated reinforcing members amongst the plurality of elongated reinforcing members including respective strap guiding members, the strap guiding members extending longitudinally along the at least some elongated reinforcing members;

f) wherein at least some of the straps engage respective ones of the strap guiding members of the plurality of elongated reinforcing members of the second pallet.

2. The assembly of stacked mattresses defined in claim 1, wherein the strap guiding members are made at least in part of a metallic material.

3. The assembly of stacked mattresses defined in claim 1, wherein the supporting member of the second pallet is made at least in part of a wood-based material.

4. The assembly of stacked mattresses defined in claim 3, wherein the wood-based material is a medium-density fibreboard (MDF).

5. The assembly of stacked mattresses defined in claim 3, wherein the wood-based material is a plywood material.

6. The assembly of stacked mattresses defined in claim 1, wherein the straps are made at least in part using a synthetic steel composite.

7. The assembly of stacked mattresses defined in claim 1, wherein the supporting member of the second pallet has a surface area substantially similar to a surface area of an individual mattress in the plurality of mattresses.

8. The assembly of stacked mattresses defined in claim 1, wherein the supporting member of the second pallet has a substantially rectangular shape.

9. The assembly of mattresses defined in claim 1, wherein said plurality of mattresses includes at least two mattresses.

10. The assembly of stacked mattresses defined in claim 1, wherein the first pallet is comprised of:

i) a supporting member; and ii) a plurality of elongated reinforcing members extending across the supporting member, at least some reinforcing members amongst the plurality of elongated reinforcing members of the first pallet including respective strap guiding members extending longitudinally along the at least some elongated reinforcing members;

wherein at least some straps engage respective ones of the strap guiding members of the at least some elongated reinforcing members of the first pallet.

11. The assembly of stacked mattresses defined in claim 1, wherein the first pallet is a bottom pallet and wherein the second pallet is a top pallet.

12. A pallet for use in shipping bedding products, the pallet comprising:

i) a supporting member; and ii) a plurality of elongated reinforcing members extending across the supporting member, at least some reinforcing members amongst the plurality of elongated reinforcing members including respective strap guiding members, the strap guiding members extending longitudinally along the elongated reinforcing members.

13. The pallet defined in claim 12, wherein the strap guiding members are made at least in part of a metallic material.

14. The pallet defined in claim 12, wherein the supporting member of the pallet is made at least in part of a wood-based material.

15. The pallet defined in claim 14, wherein the wood-based material is a medium-density fibreboard (MDF).

16. The pallet defined in claim 14, wherein the wood-based material is a plywood material.

17. The pallet defined in claim 12, wherein the supporting member has a substantially rectangular shape.

18. Use of the pallet defined in claim 12, for shipping bedding products.

19. Use of the pallet defined in claim 12, for shipping mattresses.

20. A method for preparing mattresses for shipment, said method comprising:

a) providing a first pallet and a second pallet, wherein the second pallet is comprised of:
   i) a supporting member; and
   ii) a plurality of elongated reinforcing members extending across the supporting member, at least some reinforcing members amongst the plurality of elongated reinforcing members including respective strap guiding members, the strap guiding members extending longitudinally along the at least some elongated reinforcing members;

b) placing a plurality of mattresses on a surface of one of the first pallet and the second pallet;

c) placing the other one of the first pallet and the second pallet on top of the plurality of mattresses;

d) compressing the plurality of mattresses between the first pallet and the second pallet; and e) coupling the first pallet to the second pallet using straps, the straps restraining expansion of the compressed plurality of mattresses, at least some of the straps engaging respective ones of the strap guiding members of the plurality of elongated reinforcing members of the second pallet.

21. The method defined in claim 20, wherein the strap guiding members are made at least in part of a metallic material.

22. The method defined in claim 20, wherein the supporting member of the second pallet is made at least in part of a wood-based material.

23. The method defined in claim 22, wherein the wood-based material is a medium-density fibreboard (MDF).

24. The method defined in claim 22, wherein the wood-based material is a plywood material.

25. The method defined in claim 20, wherein the straps are made at least in part using a synthetic steel composite.

26. The method defined in claim 20, wherein the supporting member of the second pallet has a surface area substantially similar to a surface area of an individual mattress in the plurality of mattresses.

27. The method defined in claim 20, wherein the supporting member of the second pallet has a substantially rectangular shape.

28. The method defined in claim 20, wherein said plurality of mattresses includes at least two mattresses.

29. The method defined in claim 20, the method further comprising compressing individually the mattresses in the plurality of mattresses prior to placing the plurality of mattresses on the first pallet.

30. The method as defined in claim 20, wherein the first pallet is comprised of:

i) a supporting member; and ii) a plurality of elongated reinforcing members extending across the supporting member, at least some reinforcing members amongst the plurality of elongated reinforcing members of the first pallet including respective strap guiding members extending longitudinally along the at least some elongated reinforcing members;

and wherein coupling the first pallet to the second pallet includes engaging at least some of the straps with respective ones of the strap guiding members of the at least some elongated reinforcing members of the first pallet.

31. An assembly of stacked mattresses prepared for shipment in accordance with the method defined in claim 20.

32. An assembly of stacked mattresses comprising:

a) a first pallet;

b) a second pallet;

c) a plurality of mattresses positioned between the first pallet and the second pallet;

d) straps coupling the first pallet to the second pallet, the plurality of mattresses being in a compressed state between the first pallet and the second pallet and the straps restraining expansion of the plurality of mattresses;

e) wherein the second pallet is comprised of:
   i) a supporting member; and
   ii) a plurality of elongated groove members extending across the supporting member;

f) wherein at least some of the straps engage respective ones of the elongated groove members of the second pallet.

33. The assembly of stacked mattresses defined in claim 32, wherein the supporting member of the second pallet is made at least in part of a wood-based material.

34. The assembly of stacked mattresses defined in claim 33, wherein the wood-based material is a medium-density fibreboard (MDF).

35. The assembly of stacked mattresses defined in claim 33, wherein the wood-based material is a plywood material.

36. The assembly of stacked mattresses defined in claim 32, wherein the straps are made at least in part using a synthetic steel composite.

37. The assembly of stacked mattresses defined in claim 32, wherein the supporting member of the second pallet has a surface area substantially similar to a surface area of an individual mattress in the plurality of mattresses.

38. The assembly of stacked mattresses defined in claim 32, wherein the supporting member of the second pallet has a substantially rectangular shape.

39. The assembly of mattresses defined in claim 32, wherein said plurality of mattresses includes at least two mattresses.

40. The assembly of stacked mattresses defined in claim 32, wherein the first pallet is comprised of:

i) a supporting member; and ii) a plurality of elongated reinforcing members extending across the supporting member, at least some reinforcing members amongst the plurality of elongated reinforcing members of the first pallet including respective strap guiding members, the strap guiding members extending longitudinally along the at least some elongated reinforcing members;

wherein at least some straps engage respective ones of the strap guiding members of the at least some elongated reinforcing members of the first pallet.

41. The assembly of stacked mattresses defined in claim 40, wherein the first pallet is a bottom pallet and wherein the second pallet is a top pallet.

* * * * *